US006935913B2

(12) United States Patent
Wyeth et al.

(10) Patent No.: US 6,935,913 B2
(45) Date of Patent: Aug. 30, 2005

(54) METHOD FOR ON-LINE TESTING OF A LIGHT EMITTING PANEL

(75) Inventors: N. Convers Wyeth, Oakton, VA (US); Albert M. Green, Springfield, VA (US); E. Victor George, Temecula, CA (US)

(73) Assignee: Science Applications International Corporation, San Diego, CA (US)

( * ) Notice: Subject to any disclaimer, the term of this patent is extended or adjusted under 35 U.S.C. 154(b) by 112 days.

(21) Appl. No.: 10/214,716

(22) Filed: Aug. 9, 2002

(65) Prior Publication Data

US 2003/0207643 A1 Nov. 6, 2003

Related U.S. Application Data

(63) Continuation-in-part of application No. 09/697,498, filed on Oct. 27, 2000, now Pat. No. 6,620,012.

(51) Int. Cl.[7] ..... H01J 9/24
(52) U.S. Cl. ..... 445/3; 445/24
(58) Field of Search ..... 445/3, 24, 25, 445/4

(56) References Cited

U.S. PATENT DOCUMENTS

| | | | | |
|---|---|---|---|---|
| 3,559,190 | A | 1/1971 | Blitzer et al. | 340/173 |
| 3,646,384 | A | 2/1972 | Lay | 313/109.5 |
| 3,704,052 | A | 11/1972 | Coleman | 316/17 |
| 3,755,027 | A | 8/1973 | Gilsing | 156/67 |
| 3,848,248 | A | 11/1974 | MacIntyre, Jr. | 340/324 M |
| 3,969,651 | A | 7/1976 | Greeson, Jr. | 315/169 TV |
| 3,990,068 | A | 11/1976 | Mayer et al. | 340/324 M |
| 3,998,618 | A | 12/1976 | Kreick et al. | 65/105 |
| 4,027,246 | A | 5/1977 | Caccoma et al. | 235/151.1 |
| 4,035,690 | A | 7/1977 | Roeber | 315/169 TV |
| 4,303,433 | A | 12/1981 | Torobin | 65/21.4 |
| 4,379,301 | A | 4/1983 | Fischbeck | 346/1.1 |
| 4,386,358 | A | 5/1983 | Fischbeck | 346/1.1 |
| 4,393,326 | A | 7/1983 | Kamegaya et al. | 313/582 |
| 4,429,303 | A | 1/1984 | Aboelfotoh | 340/701 |
| 4,534,743 | A | 8/1985 | D'Ononfrio et al. | 445/24 |
| 4,554,537 | A | 11/1985 | Dick | 340/775 |
| 4,563,617 | A | 1/1986 | Davidson | 315/312 |

(Continued)

FOREIGN PATENT DOCUMENTS

| | | | |
|---|---|---|---|
| JP | 4-287397 | 10/1992 | H05K/9/00 |
| JP | 10-3869 | 1/1998 | H01J/31/12 |
| WO | WO 00/36465 | 6/2000 | G02F/1/167 |

OTHER PUBLICATIONS

Preliminary Examination Report for Application No. PCT/US01/42782, dated Jun. 4, 2003.
Written Opinion for Application No. PCT/US01/42782, dated Dec. 31, 2002 (mailing date).

(Continued)

*Primary Examiner*—Joseph Williams
(74) *Attorney, Agent, or Firm*—Kilpatrick Stockton LLP

(57) ABSTRACT

A method of testing a light-emitting panel and the component parts therein including an assembled web containing light-emitting micro-components is disclosed. The method utilizes radiometric measuring devices disposed throughout a continuous fabrication process. Qualities of the components are measured so that product defects or process deficiencies can be corrected or eliminated.

19 Claims, 20 Drawing Sheets

U.S. PATENT DOCUMENTS 4,591,847 A 5/1986 Criscimagna et al. ..... 340/776
4,654,561 A 3/1987 Shelton ..... 315/111.71
4,658,269 A 4/1987 Rezanka ..... 346/75
4,697,123 A 9/1987 Shinoda et al. ..... 315/169.4
4,728,864 A 3/1988 Dick ..... 315/169.3
4,833,463 A 5/1989 Dick et al. ..... 340/775
4,843,281 A 6/1989 Mendelsohn ..... 313/587
4,887,003 A 12/1989 Parker ..... 313/634
4,912,364 A 3/1990 Hollo et al. ..... 313/623
5,019,807 A 5/1991 Stapleton et al. ..... 340/718
5,030,888 A 7/1991 Salavin et al. ..... 315/169.4
5,062,916 A 11/1991 Aufderheide et al. ..... 156/269
5,068,916 A 11/1991 Harrison et al. ..... 455/39
5,071,380 A * 12/1991 Hoshinouchi et al. ..... 445/4
5,075,597 A 12/1991 Deschamps et al. ..... 315/169.4
5,126,632 A 6/1992 Parker ..... 313/634
5,150,007 A 9/1992 Andreadakis ..... 313/586
5,315,129 A 5/1994 Forrest et al. ..... 257/21
5,396,149 A 3/1995 Kwon ..... 313/486
5,500,287 A 3/1996 Henderson ..... 428/403
5,501,871 A 3/1996 Henderson ..... 427/160
5,510,678 A 4/1996 Sakai et al. ..... 315/58
5,514,934 A 5/1996 Matsumoto et al. ..... 313/607
5,674,351 A 10/1997 Lovoi ..... 156/629.1
5,675,212 A 10/1997 Schmid et al. ..... 313/422
5,686,790 A 11/1997 Curtin et al. ..... 313/493
5,703,436 A 12/1997 Forrest et al. ..... 313/506
5,707,745 A 1/1998 Forrest et al. ..... 428/432
5,721,160 A 2/1998 Forrest et al. ..... 438/28
5,725,787 A 3/1998 Curtin et al. ..... 216/25
5,746,635 A 5/1998 Spindt et al. ..... 445/24
5,747,931 A 5/1998 Riddle et al. ..... 313/581
5,755,944 A 5/1998 Haven et al. ..... 204/486
5,757,026 A 5/1998 Forrest et al. ..... 257/40
5,757,131 A 5/1998 Tsuchiya ..... 375/582
5,757,139 A 5/1998 Forrest et al. ..... 315/169.3
5,777,782 A 7/1998 Sheridon ..... 359/296
5,788,814 A 8/1998 Sun et al. ..... 204/297 R
5,793,158 A 8/1998 Wedding, Sr. ..... 313/493
5,798,604 A 8/1998 Duboc, Jr. et al. ..... 313/495
5,808,403 A 9/1998 Clerc ..... 313/336
5,811,833 A 9/1998 Thompson ..... 257/40
5,815,306 A 9/1998 Sheridon et al. ..... 359/296
5,825,451 A 10/1998 Ma et al. ..... 349/187
5,837,221 A 11/1998 Bernstein et al. ..... 424/9.52
5,844,363 A 12/1998 Gu et al. ..... 313/506
5,853,446 A 12/1998 Carre et al. ..... 65/17.3
5,862,054 A 1/1999 Li ..... 364/468.28
5,865,657 A 2/1999 Haven et al. ..... 445/24
5,897,414 A 4/1999 Bergeron et al. ..... 445/3
5,898,266 A 4/1999 Spindt et al. ..... 313/495
5,913,704 A 6/1999 Spindt et al. ..... 445/24
5,914,150 A 6/1999 Porter et al. ..... 427/77
5,917,646 A 6/1999 Sheridon ..... 359/296
5,920,080 A 7/1999 Jones ..... 257/40
5,945,174 A 8/1999 Shaw et al. ..... 427/509
5,949,513 A 9/1999 Ma et al. ..... 349/187
5,953,587 A 9/1999 Forrest et al. ..... 438/99
5,964,630 A 10/1999 Slusarczuk et al. ..... 445/25
5,965,109 A 10/1999 Lohrmann ..... 424/9.52
5,967,871 A 10/1999 Kaake et al. ..... 445/24
5,969,472 A 10/1999 Kisner ..... 313/484
5,975,683 A 11/1999 Smith et al. ..... 347/55
5,984,747 A 11/1999 Bhagavatula et al. ..... 445/24
5,985,460 A 11/1999 Wang et al. ..... 428/426
5,986,409 A 11/1999 Farnworth et al. ..... 315/169.4
5,990,614 A 11/1999 Spindt ..... 313/495
5,990,620 A 11/1999 Lepselter ..... 313/585
6,002,198 A 12/1999 Spindt et al. ..... 313/292
6,013,538 A 1/2000 Burrows et al. ..... 438/22
6,017,584 A 1/2000 Albert et al. ..... 427/213.3
6,019,657 A 2/2000 Chakvorty et al. ..... 445/24
6,022,652 A 2/2000 Haven et al. ..... 430/26
6,023,259 A 2/2000 Howard et al. ..... 345/76
6,025,097 A 2/2000 Drumm ..... 430/7
6,030,269 A 2/2000 Drumm ..... 445/52
6,030,715 A 2/2000 Thompson et al. ..... 428/690
6,033,547 A 3/2000 Trau et al. ..... 204/622
6,037,710 A 3/2000 Poole et al. ..... 313/422
6,037,918 A 3/2000 Hansen et al. ..... 345/74
6,038,002 A 3/2000 Song ..... 349/43
6,039,619 A 3/2000 Kang et al. ..... 445/24
6,045,930 A 4/2000 Thompson et al. ..... 428/690
6,046,543 A 4/2000 Bulovic et al. ..... 313/504
6,048,469 A 4/2000 Xiang et al. ..... 252/301.6 R
6,048,630 A 4/2000 Burrows et al. ..... 428/690
6,049,366 A 4/2000 Hakemi et al. ..... 349/86
6,069,443 A 5/2000 Jones et al. ..... 313/504
6,072,276 A 6/2000 Okajima ..... 313/581
6,079,814 A 6/2000 Lean et al. ..... 347/55
6,080,606 A 6/2000 Gleskova et al. ..... 438/151
6,087,196 A 7/2000 Sturm et al. ..... 438/29
6,091,195 A 7/2000 Forrest et al. ..... 313/504
6,091,380 A 7/2000 Hashimoto et al. ..... 345/60
6,091,874 A 7/2000 Higashi et al. ..... 384/130
6,097,147 A 8/2000 Baldo et al. ..... 313/506
6,130,655 A 10/2000 Lammers ..... 345/72
6,137,553 A 10/2000 Izumi et al. ..... 349/49
6,201,518 B1 3/2001 Kane et al. ..... 345/60
6,255,777 B1 7/2001 Kim et al. ..... 313/582
6,262,706 B1 7/2001 Albert et al. ..... 345/107
6,265,826 B1 7/2001 Miyazaki ..... 313/586
6,281,863 B1 8/2001 Sasaki et al. ..... 345/60
6,285,129 B1 9/2001 Park et al. ..... 313/586
6,285,434 B1 9/2001 Ma et al. ..... 349/189
6,288,488 B1 9/2001 Amemiya ..... 313/582
6,288,693 B1 9/2001 Song et al. ..... 345/68
6,291,925 B1 9/2001 Jacobson ..... 310/319
6,292,159 B1 9/2001 Someya et al. ..... 345/60
6,292,160 B1 9/2001 Mikoshiba et al. ..... 345/60
6,295,040 B1 9/2001 Nhan et al. ..... 345/60
6,296,539 B1 10/2001 Awaji et al. ..... 445/24
6,297,590 B1 10/2001 Nanto et al. ..... 313/586
6,300,152 B1 10/2001 Kim ..... 438/30
6,300,932 B1 10/2001 Albert ..... 345/107
6,304,031 B1 10/2001 Wani et al. ..... 313/582
6,304,032 B1 10/2001 Asano ..... 313/582
6,304,238 B1 10/2001 Tsuchida ..... 345/87
6,307,319 B1 10/2001 Lee ..... 313/590
6,312,304 B1 11/2001 Duthaler et al. ..... 445/24
6,312,971 B1 11/2001 Amundson et al. ..... 438/99
6,319,325 B1 11/2001 Hiratsuka et al. ..... 118/718
6,322,010 B1 11/2001 Sasaki et al. ..... 239/568
2001/0008825 A1 7/2001 Toyoda et al. ..... 445/24
2001/0033256 A1 10/2001 Moore ..... 345/60
2001/0053570 A1 12/2001 Kido ..... 438/149
2002/0008470 A1 1/2002 Uegaki et al. ..... 313/567
2002/0009536 A1 1/2002 Iguchi et al. ..... 427/10
2002/0016075 A1 2/2002 Peng et al. ..... 438/700
2002/0017864 A1 2/2002 Watanabe et al. ..... 313/586
2002/0022565 A1 2/2002 Sreeram et al. ..... 501/16
2002/0024295 A1 2/2002 Miyashita et al. ..... 313/495

OTHER PUBLICATIONS

International Search Report for Application No. PCT/US01/42807, dated Dec. 8, 2002 (mailing date).

International Search Report for Application No. PCT/US01/51439, dated Sep. 23, 2002 (mailing date).

Written Opinion for Application No. PCT/US01/42807, dated Sep. 17, 2002 (mailing date).

International Search Report for Application No. PCT/US01/42807, dated May 20, 2002 (mailing date).
International Search Report for Application No. PCT/US01/42782, dated Apr. 11, 2002 (mailing date).
Sheats, James, "Introduction to Organic Light–Emitting Diodes (OLEDs)" [online], [received on May 9, 2002], 8 pp., Retrieved from the Internet: http://www.rolltronics.com/intro_pled.htm.
Sauvante, Micheal, "Roll–to–Roll Manufacturing" [online], [retreived on May 9, 2002], 4 pp., Retrieved from the Internet: http://www.rolltronics.com/roll2roll.htm.
Veronis, Georgios and Inan, Umran S., "Optimization of the Luminous Efficiency of Plasma Display Panels Using Numerical Modeling" [online], [retrieved on Mar. 13, 2002], 8 pp., Retrieved from the Internet: http://www–star.stanford.edu/~vlf/plasma_display/index.htm.
Smilgys, Russell, et al., "Progress Toward Roll Processing of Solar Reflective Material," *Proceedings of Solar Forum 2001 Solar Energy: The Power to Choose*, Washington, DC, 8 pp., Apr. 21–25, 2001.
Srinivasan, Uthara, et al., "Microstructure to Substrate Self–Assembly Using Capillary Forces," *Nournal of Microelectromechanical Systems*, vol. 10, No. 1, Mar., 2001, pp. 17–17–24.
Chutinan, Alongkarn and Noda, Susumu, "Waveguides and Waveguide Bends in Two–Dimensional Photonic Crystal Slabs," *The American Physical Society*, vol. 62, No. 7, 5 pp., Aug. 15, 2000.
"Rolltronics" [online], Feb. 20, 2000 [retreived on Mar. 12, 2000], 13 pp., Retrieved from the Internet: http://www.rolltronics.com.
"Electronics & Telecommunications" [online], LG Electronics, Copyright 2001 [retrieved on Nov. 7, 2001], 1 p., Retrieved from the Internet: http://www.lg.co.kr/English/company/electronic/index.jsp?code=A3.
"New Product" [online], LG Electronics, Copyright 2001 [retrieved on Nov. 7, 2001], 1 p., Retrieved from the Internet: http://www.lge.com.
"Monitor" [online], LG Electronics, Copyright 2001 [retrieved on Nov. 7, 2001], 2 pp., Retrieved from the Internet: http://www.lgeus.com/Product/Monitor/newmonitors.asp.
"LG Electronics Introduces 42–Inch Digital PDP TV" [online], LG Electronics, Copyright 2001 [retrieved on Nov. 7, 2001], 2 pp., Retrieved from the Internet: http://www.pdpdisplay.com/eng/news/e_read.as?nSeqno=22.
"LG PDP Now Available at World Renowned Harrods Department Store" [online], LG Electronics, Copyright 2001 [retrieved on Nov. 7, 2001], 2 pp., Retrieved from the Internet: http://www.pdpdisplay.com/eng/news/e_read.asp?nSeqno21.
"LG Electronics Becomes First in Korea to Export PDP Module" [online], LG Electronics, Copyright 2001 [retrieved on Nov. 7, 2001], 2 pp., Retrieved from the Internet: http://www.pdpdisplay.com/eng/news/e_read.asp?nSeqNo=19&type=&word=.
"LG Electronics—To the Top in PDP Business" [online], LG Electronics, Copyright 2001 [retrieved on Nov. 7, 2001], 2 pp., Retrieved from the Internet: http://www.pdpdisplay.com/eng/news/e_read.asp?nSeqNo=16&type=&word=.
"LG Electronics Becomes the First in Korea to Export PDP" [online], LG Electronics, Copyright 2001 [retrieved on Nov. 7, 2001], 2 pp., Retrieved from the Internet: http://www.pdpdisplay.com/eng/news/e_read.asp?nSeqNo=14&type=&word=.
"LG Electronics Held the Ceremony for the Complexion of the PDP Factory" [online], LG Electronics, Copyright 2001 [retrieved on Nov. 7, 2001], 2 pp., Retrieved from the Internet: http://www.pdpdisplay.com/eng/news/e_read.asp?nSeqNo=13&type=&word.
"Runco PlasmaWall Systems with Vivex Processing" [online], Copyright 2001 [retrieved on Jan. 17, 2002], 2 pp., Retrieved from the Internet: http://www.runco.com/Products/Plasma/Default.htm.
"Runco PlasmaWall PL–42cx" [online], Copyright 2001 [retrieved on Jan. 17, 2002], 2 pp., Retrieved from the Internet: http://www.runco.com/Products/Plasma/PL42cx.htm.
"Runco PlasmaWall Pl–50c" [online], Copyright 2001 [retrieved on Jan. 17, 2002], 2 pp., Retrieved from the Internet: http://www.runco.com/Products/Plasma/PL50c.htm.
"Runco PlasmaWall™ PL–61cx" [online], Copyright 2001 [retrieved on Jan. 17, 2002], 2 pp., Retrieved from the Internet: http://www.runco.com/Products/Plasma/PL61.htm.
Alien Technology Corporation's Technology Overview; copyright © 2000, Alien Technology™; http://www.alientechnology.com/d/technology/overview.html, no month.
Anonymous, *Alien Technology Corporation White Paper—Fluidic Self Assembly*, Alien Technology Corp., Oct. 1999, pp. 1–7.
Shin, Y. K., Lee, J. K., Shon, C. H., "Two–Dimensional Breakdown Characteristics of PDP Cells for Varying Geometry," *IEEE Transactions on Plasma Science*, vol. 27, No. 1, Feb., 1999, pp. 14–15.
Raulf, S., Kushner, M. J., "Operation of a Coplanar–Electrode Plasma Display Panel Cell," *IEEE Transactions on Plasma Science*, vol. 27, No. 1, Feb. 1999, pp. 10–11.
Kurihara, M., Makabe, T., "Two–Dimensional Modeling of a Micro–Cell Plasma in Xe Driven by High Frequency," *IEEE Transactions on Plasma Science*, vol. 27, No. 5, Oct., 1999, pp. 1372–1378.
Peterson, "Rethinking Ink" [online], Science News, vol. 153, No. 25, Jun. 20, 1998 [retrieved on Dec. 4, 2002], 7 pp., Retrieved from the Internet: http://www.sciencenews.org/sn_arc98/6_20_98/bob2.htm.
"Transparent Conductive Coatings," Copyright 1998, 4 pp., no month.
Lin, Yi–Zhen, et al., "A New Method of Analyzing the Light Transmission in Leaky and Absorbing Planar Waveguides," *IEEE Photonics Technology Letters*, vol. 9, No. 9, Sep., 1997, pp. 1241–.
Jacobson, et al., "The Last Book" [online], IBM Systems Journal, vol. 36, No. 3, 1997 [retrieved on Dec. 4, 2002], 6 pp., Retrieved from the Internet: http://www.research.ibm.com/journal/sj/363/Jacobson.html.
Stearns, Thomas H., "Flexible Printed Circuitry," 6 pp., 1996, no month.
"Flat Panel Displays in Perspective," 44 pp., Sep., 1995.
Franjione, et al., "The Art and Science of Microencapsulation" [online] Technology Today, Summer, 1995 [retrieved on Dec. 4, 2002], 10 pp., Retrieved from the Internet: http://www.swri.edu/3pubs/ttoday/summer95/microeng.htm.
International Search Report for Application No. PCT/US01/42805, dated Apr. 3, 2003 (mailing date).
Preliminary Examination Report for Application No. PCT/US01/42803, dated Sep. 22, 2003 (mailing date).

* cited by examiner

METHOD FOR ON-LINE TESTING OF A LIGHT EMITTING PANEL

CROSS-REFERENCE TO RELATED APPLICATIONS

The following application is a Continuation-In-Part of U.S. application Ser. No. 09/697,498 filed Oct. 27, 2000 now U.S. Pat. No. 6,620,012.

The entire disclosures of U.S. patent application Ser. Nos. 09/697,345, 09/697,346, 09/697,358, and 09/697,344 all of which were filed on Oct. 27, 2000 are hereby incorporated herein by reference. In addition, the entire disclosures of the following applications filed on the same date as the present application are hereby incorporated herein by reference: Method and Apparatus for Addressing Micro-Components in a Plasma Display Panel (Attorney Docket Number SAIC0026-CIP); Design, Fabrication, Testing and Conditioning of Micro-Components for Use in a Light-Emitting Panel (Attorney Docket Number SAIC0027-CIP); Liquid Manufacturing Process for Panel Layer Fabrication (Attorney Docket Number SAIC0029-CIP1); and Use of Printing and Other Technology for Micro-Component Placement (Attorney Docket Number SAIC0029-CIP2).

BACKGROUND OF THE INVENTION

1. Field of the Invention

The present invention is directed to methods for testing light-emitting displays on-line during a continuous fabrication process.

2. Description of Related Art

In a typical plasma display, a gas or mixture of gases is enclosed between orthogonally crossed and spaced conductors. The crossed conductors define a matrix of crossover points, arranged as an array of miniature picture elements (pixels), which provide light. At any given pixel, the orthogonally crossed and spaced conductors function as opposed plates of a capacitor, with the enclosed gas serving as a dielectric. When a sufficiently large voltage is applied, the gas at the pixel breaks down creating free electrons that are drawn to the positive conductor and positively charged gas ions that are drawn to the negatively charged conductor. These free electrons and positively charged gas ions collide with other gas atoms causing an avalanche effect creating still more free electrons and positively charged ions, thereby creating plasma. The voltage level at which this ionization occurs is called the write voltage.

Upon application of a write voltage, the gas at the pixel ionizes and emits light only briefly as free charges formed by the ionization migrate to the insulating dielectric walls of the cell where these charges produce an opposing voltage to the applied voltage and thereby extinguish the ionization. Once a pixel has been written, a continuous sequence of light emissions can be produced by an alternating sustain voltage. The amplitude of the sustain waveform can be less than the amplitude of the write voltage, because the wall charges that remain from the preceding write or sustain operation produce a voltage that adds to the voltage of the succeeding sustain waveform applied in the reverse polarity to produce the ionizing voltage. Mathematically, the idea can be set out as $V_s=V_w-V_{wall}$, where $V_s$ is the sustain voltage, $V_w$ is the write voltage, and $V_{wall}$ is the wall voltage. Accordingly, a previously unwritten (or erased) pixel cannot be ionized by the sustain waveform alone. An erase operation can be thought of as a write operation that proceeds only far enough to allow the previously charged cell walls to discharge; it is similar to the write operation except for timing and amplitude.

Typically, there are two different arrangements of conductors that are used to perform the write, erase, and sustain operations. The one common element throughout the arrangements is that the sustain and the address electrodes are spaced apart with the plasma-forming gas in between. Thus, at least one of the address or sustain electrodes is located within the path the radiation travels, when the plasma-forming gas ionizes, as it exits the plasma display. Consequently, transparent or semi-transparent conductive materials must be used, such as indium tin oxide (ITO), so that the electrodes do not interfere with the displayed image from the plasma display. Using ITO, however, has several disadvantages; for example, ITO is expensive and adds significant cost to the manufacturing process and ultimately the final plasma display.

The first arrangement uses two orthogonally-crossed conductors, one addressing conductor and one sustaining conductor. In a gas panel of this type, the sustain waveform is applied across all the addressing conductors and sustain conductors so that the gas panel maintains a previously written pattern of light-emitting pixels. For a conventional write operation, a suitable write voltage pulse is added to the sustain voltage waveform so that the combination of the write pulse and the sustain pulse produces ionization. In order to write an individual pixel independently, each of the addressing and sustain conductors has an individual selection circuit. Thus, applying a sustain waveform across all the addressing and sustain conductors, and applying a write pulse across only one addressing and one sustain conductor will produce a write operation in only the one pixel at the intersection of the selected addressing and sustain conductors.

The second arrangement uses three conductors. In panels of this type, called coplanar sustaining panels, each pixel is formed at the intersection of three conductors, one addressing conductor and two parallel sustaining conductors. In this arrangement, the addressing conductor orthogonally crosses the two parallel sustaining conductors. With this type of panel, the sustain function is performed between the two parallel sustaining conductors and the addressing is done by the generation of discharges between the addressing conductor and one of the two parallel sustaining conductors.

The sustaining conductors are of two types, addressing-sustaining conductors and solely sustaining conductors. The function of the addressing-sustaining conductors is twofold: to achieve a sustaining discharge in cooperation with the solely sustaining conductors; and to fulfill an addressing role. Consequently, the addressing-sustaining conductors are individually selectable so that an addressing waveform may be applied to any one or more addressing-sustaining conductors. The solely sustaining conductors, on the other hand, are typically connected in such a way that a sustaining waveform can be simultaneously applied to all of the solely sustaining conductors so that they can be carried to the same potential in the same instant.

Numerous types of plasma panel display devices have been constructed with a variety of methods for enclosing a plasma-forming gas between sets of electrodes. In one type of plasma display panel, parallel plates of glass with wire electrodes on the surfaces thereof are spaced uniformly apart and sealed together at the outer edges with the plasma-forming gas filling the cavity formed between the parallel plates. Although widely used, this type of open display structure has various disadvantages. The sealing of the outer edges of the parallel plates and the introduction of the plasma-forming gas are both expensive and time-consuming processes, resulting in a costly end product. In addition, it is particularly difficult to achieve a good seal at the sites where the electrodes are fed through the ends of the parallel plates. This can result in gas leakage and a shortened product lifecycle. Another disadvantage is that individual pixels are not segregated within the parallel plates. As a result, gas ionization activity in a selected pixel during a write operation may spill over to adjacent pixels, thereby raising the undesirable prospect of possibly igniting adjacent pixels. Even if adjacent pixels are not ignited, the ionization activity can change the turn-on and turn-off characteristics of the nearby pixels.

In another type of known plasma display, individual pixels are mechanically isolated either by forming trenches in one of the parallel plates or by adding a perforated insulating layer sandwiched between the parallel plates. These mechanically isolated pixels, however, are not completely enclosed or isolated from one another because there is a need for the free passage of the plasma-forming gas between the pixels to assure uniform gas pressure throughout the panel. While this type of display structure decreases spillover, spillover is still possible because the pixels are not in total electrical isolation from one another. In addition, in this type of display panel it is difficult to properly align the electrodes and the gas chambers, which may cause pixels to misfire. As with the open display structure, it is also difficult to get a good seal at the plate edges. Furthermore, it is expensive and time consuming to introduce the plasma-forming gas and seal the outer edges of the parallel plates.

In yet another type of known plasma display, individual pixels are also mechanically isolated between parallel plates. In this type of display, the plasma-forming gas is contained in transparent spheres formed of a closed transparent shell. Various methods have been used to contain the gas-filled spheres between the parallel plates. In one method, spheres of varying sizes are tightly bunched and randomly distributed throughout a single layer, and sandwiched between the parallel plates. In a second method, spheres are embedded in a sheet of transparent dielectric material and that material is then sandwiched between the parallel plates. In a third method, a perforated sheet of electrically nonconductive material is sandwiched between the parallel plates with the gas-filled spheres distributed in the perforations.

While each of the types of displays discussed above are based on different design concepts, the manufacturing approach used in their fabrication is generally the same. Conventionally, a batch fabrication process is used to manufacture these types of plasma panels. As is well known in the art, in a batch process individual component parts are fabricated separately, often in different facilities and by different manufacturers, and then brought together for final assembly where individual plasma panels are created one at a time. Batch processing has numerous shortcomings, such as, for example, the length of time necessary to produce a finished product. Long cycle times increase product cost and are undesirable for numerous additional reasons known in the art. For example, a sizeable quantity of substandard, defective, or useless fully or partially completed plasma panels may be produced during the period between detection of a defect or failure in one of the components and an effective correction of the defect or failure.

This is especially true of the first two types of displays discussed above; the first having no mechanical isolation of individual pixels, and the second with individual pixels mechanically isolated either by trenches formed in one parallel plate or by a perforated insulating layer sandwiched between two parallel plates. Due to the fact that plasma-forming gas is not isolated at the individual pixel/subpixel level, the fabrication process precludes the majority of individual component parts from being tested until the final display is assembled. Consequently, the display can only be tested after the two parallel plates are sealed together and the plasma-forming gas is filled inside the cavity between the two plates. If post-production testing shows that any number of potential problems have occurred (e.g. poor luminescence or no luminescence at specific pixels/subpixels), the entire display is discarded.

BRIEF SUMMARY OF THE INVENTION

Preferred embodiments of the present invention provide a light-emitting panel that may be used as a large-area radiation source, for energy modulation, for particle detection and as a flat-panel display. Gas-plasma panels are preferred for these applications due to their unique characteristics.

In one form, the light-emitting panel may be used as a large area radiation source. By configuring the light-emitting panel to emit ultraviolet (UV) light, the panel has application for curing, painting, and sterilization. With the addition of one or more phosphor coatings to convert the UV light to visible white light, the panel also has application as an illumination source.

In addition, the light-emitting panel may be used as a plasma-switched phase array by configuring the panel in at least one embodiment in a microwave transmission mode. The panel is configured in such a way that during ionization the plasma-forming gas creates a localized index of refraction change for the microwaves (although other wavelengths of light would work). The microwave beam from the panel can then be steered or directed in any desirable pattern by introducing at a localized area a phase shift and/or directing the microwaves out of a specific aperture in the panel.

Additionally, the light-emitting panel may be used for particle/photon detection. In this embodiment, the light-emitting panel is subjected to a potential that is just slightly below the write voltage required for ionization. When the device is subjected to outside energy at a specific position or location in the panel, that additional energy causes the plasma-forming gas in the specific area to ionize, thereby providing a means of detecting outside energy.

Further, the light-emitting panel may be used in flat-panel displays. These displays can be manufactured very thin and lightweight, when compared to similarly sized cathode ray tube displays (CRTs), making them ideally suited for home, office, theaters and billboards. In addition, these displays can be manufactured in large sizes and with sufficient resolution to accommodate high-definition television (HDTV). Gas-plasma panels do not suffer from electromagnetic distortions and are, therefore, suitable for applications strongly affected by magnetic fields, such as military applications, radar systems, railway stations and other underground systems.

According to one general embodiment of the present invention, a light-emitting panel is made from two substrates, wherein one of the substrates includes a plurality of sockets and wherein at least two electrodes are disposed. At least partially disposed in each socket is a micro-component, although more than one micro-component may be disposed therein. Each micro-component includes a shell at least partially filled with a gas or gas mixture capable of ionization. When a large enough voltage is applied across the micro-component, the gas or gas mixture ionizes forming plasma and emitting radiation.

The present invention is also directed to a method for in-line or on-line testing light-emitting panels. The light-emitting panels and the components contained therein, including the assembled web containing the light-emitting micro-components, are tested during a continuous fabrication process. Testing can occur throughout the fabrication process after each assembly step is completed. The results of the tests are analyzed to determine whether the result is within acceptable tolerances, and the process is adjusted or the assembled web is fixed accordingly. After any corrections are made, the light-emitting panel and its components can be re-tested. The testing occurs at the speed of the continuous fabrication process.

In another embodiment of the present invention, a method for forming a light-emitting panel includes providing a first substrate, forming a plurality of cavities on or within the first substrate, placing at least one micro-component in each cavity, providing a second substrate opposed to the first substrate such that at least one micro-component is sandwiched between the first and second substrates, disposing at least two electrodes so that voltage supplied to the at least two electrodes causes one or more micro-components to emit radiation; and inline testing at least one of the first substrate, at least one cavity, at least one micro-component, at least one electrode, and the second substrate.

Other features, advantages, and embodiments of the invention are set forth in part in the description that follows, and in part, will be obvious from this description, or may be learned from the practice of the invention.

BRIEF DESCRIPTION OF THE DRAWINGS

The foregoing and other objects, features and advantages of this invention will become more apparent by reference to the following detailed description of the invention taken in conjunction with the accompanying drawings, wherein.

DETAILED DESCRIPTION OF THE PREFERRED EMBODIMENTS OF THE INVENTION

As embodied and broadly described herein, the preferred embodiments of the present invention are directed to a novel light-emitting panel. In particular, preferred embodiments are directed to light-emitting panels and a method for testing light-emitting panels and the components therein.

Figure 1:
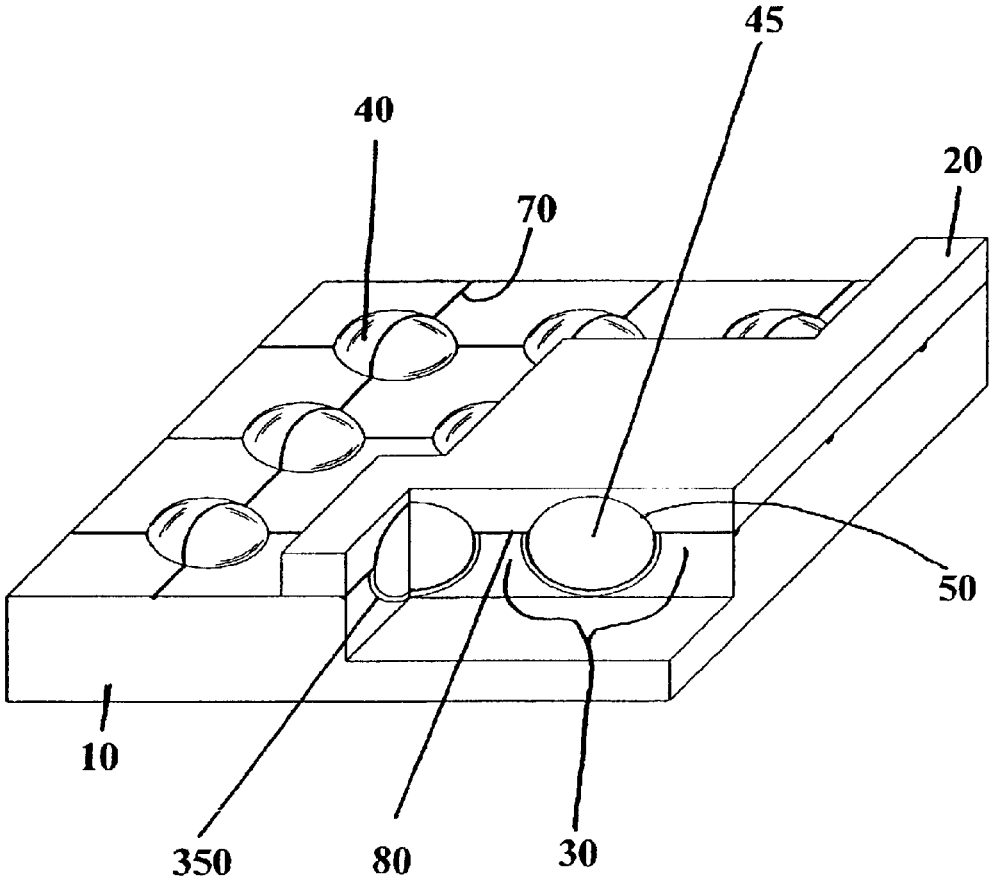
FIG. 1 depicts a portion of a light-emitting panel showing the basic socket structure of a socket formed from patterning a substrate, as disclosed in an embodiment of the present invention.
Figure 2:
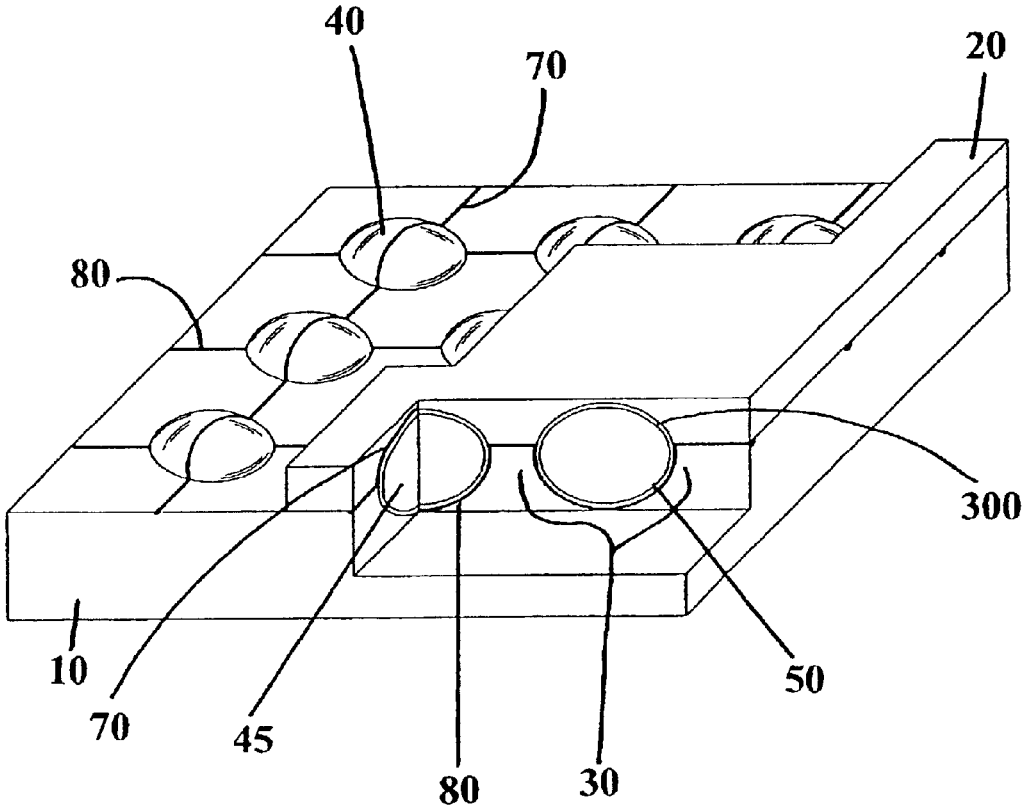
FIG. 2 depicts a portion of a light-emitting panel showing the basic socket structure of a socket formed from patterning a substrate, as disclosed in another embodiment of the present invention.
Figure 3A:
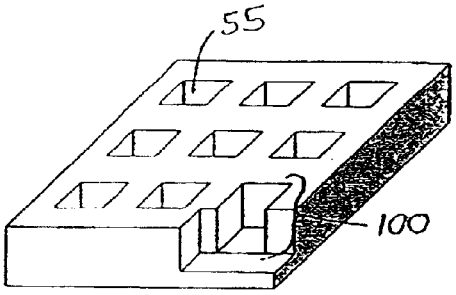
FIG. 3A shows an example of a cavity that has a cube shape.
Figure 3B:
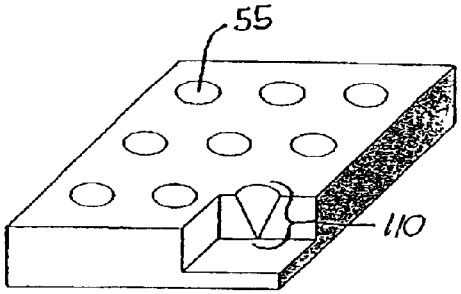
FIG. 3B shows an example of a cavity that has a cone shape.
Figure 3C:
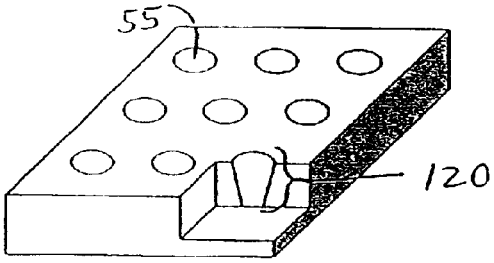
FIG. 3C shows an example of a cavity that has a conical frustum shape.
Figure 3D:
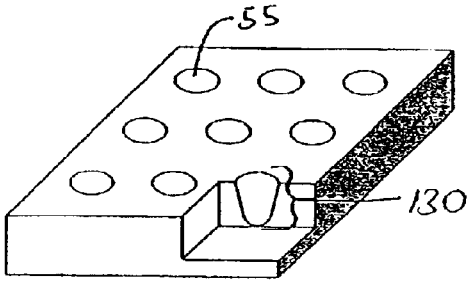
FIG. 3D shows an example of a cavity that has a paraboloid shape.
Figure 3E:
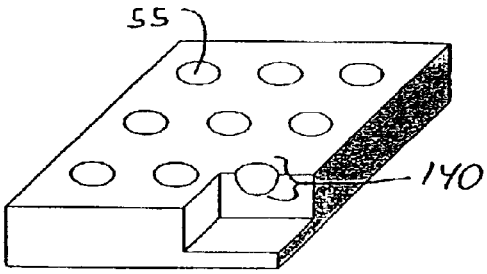
FIG. 3E shows an example of a cavity that has a spherical shape.
Figure 3F:
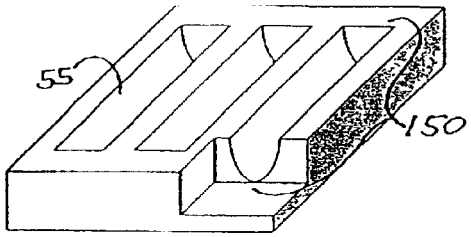
FIG. 3F shows an example of a cavity that has a cylindrical shape.
Figure 3G:
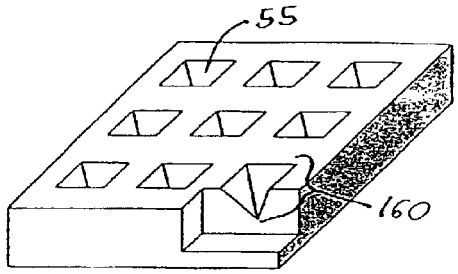
FIG. 3G shows an example of a cavity that has a pyramid shape.
Figure 3H:
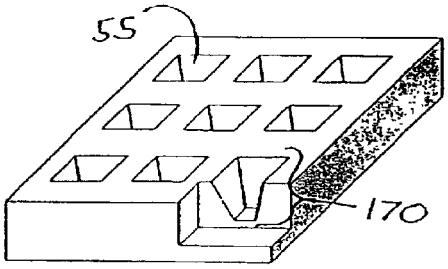
FIG. 3H shows an example of a cavity that has a pyramidal frustum shape.
Figure 3I:
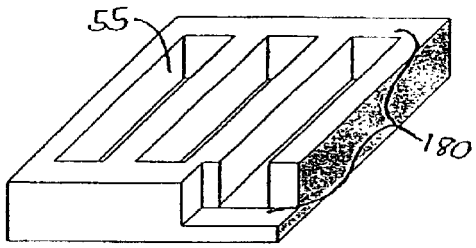
FIG. 3I shows an example of a cavity that has a parallelepiped shape.
Figure 3J:
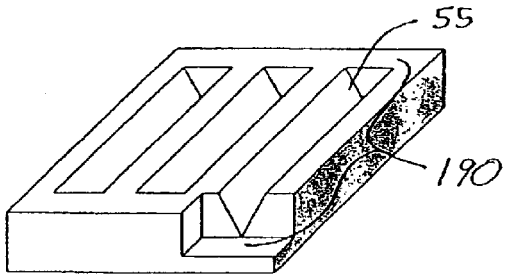
FIG. 3J shows an example of a cavity that has a prism shape.

FIGS. 1 and 2 show two embodiments of the present invention wherein a light-emitting panel includes a first substrate 10 and a second substrate 20. The first substrate 10 and the second substrate 20 may be made from silicates, polypropylene, quartz, glass, any polymeric-based material or any material or combination of materials known to one skilled in the art. The first substrate 10 and second substrate 20 may both be made from the same material or from a different material. Additionally, the first and second substrates 10,20 may be made of materials that dissipate heat from the light-emitting panel. In a preferred embodiment, the first and second substrates 10,20 are made from materials that are mechanically flexible.

The first substrate 10 includes a plurality of sockets 30. The sockets 30 may be disposed in any pattern, having uniform or non-uniform spacing between adjacent sockets. Patterns may include, but are not limited to, alphanumeric characters, symbols, icons, or pictures. Preferably, the sockets 30 are disposed in the first substrate 10 so that the distance between adjacent sockets 30 is approximately equal. Sockets 30 may also be disposed in groups such that the distance between one group of sockets and another group of sockets is approximately equal. This latter approach may be particularly relevant in color light-emitting panels, where each socket in each group of sockets may represent red, green and blue, respectively.

At least partially disposed in each socket 30 is at least one micro-component 40. Multiple micro-components may be disposed in a socket to provide increased luminosity and enhanced radiation transport efficiency. In a color light-emitting panel according to one embodiment of the present invention, a single socket supports three micro-components configured to emit red, green, and blue light, respectively. The micro-components 40 may be of any shape, including, but not limited to, spherical, cylindrical, and aspherical. In addition, it is contemplated that a micro-component 40 includes a micro-component placed or formed inside another structure, such as placing a spherical micro-component inside a cylindrical-shaped structure. In a color light-emitting panel according to an embodiment of the present invention, each cylindrical-shaped structure holds micro-components configured to emit a single color of visible light or multiple colors arranged red, green, blue, or in some other suitable color arrangement.

In another embodiment of the present invention, an adhesive or bonding agent is applied to each micro-component to assist in placing/holding a micro-component 40 or plurality of micro-components in a socket 30. In an alternative embodiment, an electrostatic charge is placed on each micro-component and an electrostatic field is applied to each micro-component to assist in the placement of a micro-component 40 or plurality of micro-components in a socket 30. Applying an electrostatic charge to the micro-components also helps avoid agglomeration among the plurality of micro-components. In one embodiment of the present invention, an electron gun is used to place an electrostatic charge on each micro-component, and one electrode disposed proximate to each socket 30 is energized to provide the needed electrostatic field required to attract the electrostatically charged micro-component.

Alternatively, in order to assist placing/holding a micro-component 40 or plurality of micro-components in a socket 30, a socket 30 may contain a bonding agent or an adhesive. The bonding agent or adhesive may be applied to the inside of the socket 30 by differential stripping, lithographic process, sputtering, laser deposition, chemical deposition, vapor deposition, or deposition using ink jet technology. One skilled in the art will realize that other methods of coating the inside of the socket 30 may be used.

In its most basic form, each micro-component 40 includes a shell 50 filled with a plasma-forming gas or gas mixture 45. Any suitable gas or gas mixture 45 capable of ionization may be used as the plasma-forming gas, including, but not limited to, krypton, xenon, argon, neon, oxygen, helium, mercury, and mixtures thereof. In fact, any noble gas could be used as the plasma-forming gas, including, but not limited to, noble gases mixed with cesium or mercury. Further, rare gas halide mixtures such as xenon chloride, xenon fluoride and the like are also suitable plasma-forming gases. Rare gas halides are efficient radiators having radiating wavelengths of approximately 300 to 350 nm, which is longer than that of pure xenon (147 to 170 nm). This results in an overall quantum efficiency gain, i.e., a factor of two or more, given by the mixture ratio. Still further, in another embodiment of the present invention, rare gas halide mixtures are also combined with other plasma-forming gases as listed above. This description is not intended to be limiting, and one skilled in the art would recognize other gasses or gas mixtures that could also be used.

In a color display, according to another embodiment, the plasma-forming gas or gas mixture 45 is chosen so that during ionization the gas will irradiate a specific wavelength of light corresponding to a desired color. For example, neon-argon emits red light, xenon-oxygen emits green light, and krypton-neon emits blue light. While a plasma-forming gas or gas mixture 45 is used in a preferred embodiment, any other material capable of providing luminescence is also contemplated, such as an electro-luminescent material, organic light-emitting diodes (OLEDs), or an electrophoretic material.

The shell 50 may be made from a wide assortment of materials, including, but not limited to, silicates, polypropylene, glass, any polymeric-based material, magnesium oxide and quartz and may be of any suitable size. The shell 50 may have a diameter ranging from micrometers to centimeters as measured across its minor axis, with virtually no limitation as to its size as measured across its major axis. For example, a cylindrical-shaped micro-component may be only 100 microns in diameter across its minor axis, but may be hundreds of meters long across its major axis. In a preferred embodiment, the outside diameter of the shell, as measured across its minor axis, is from 100 microns to 300 microns. In addition, the shell thickness may range from micrometers to millimeters, with a preferred thickness from 1 micron to 10 microns.

When a sufficiently large voltage is applied across the micro-component the gas or gas mixture ionizes forming plasma and emitting radiation. The potential required to initially ionize the gas or gas mixture inside the shell 50 is governed by Paschen's Law and is closely related to the pressure of the gas inside the shell. In the present invention, the gas pressure inside the shell 50 ranges from tens of torrs to several atmospheres. In a preferred embodiment, the gas pressure ranges from 100 torr to 700 torr. The size and shape of a micro-component 40 and the type and pressure of the plasma-forming gas contained therein, influence the performance and characteristics of the light-emitting panel and are selected to optimize the panel's efficiency of operation.

There are a variety of coatings 300 and dopants that may be added to a micro-component 40 that also influence the performance and characteristics of the light-emitting panel. The coatings 300 may be applied to the outside or inside of the shell 50, and may either partially or fully coat the shell 50. Types of outside coatings include, but are not limited to, coatings used to convert UV light to visible light (e.g. phosphor), coatings used as reflecting filters, and coatings used as band-gap filters. Types of inside coatings include, but are not limited to, coatings used to convert UV light to visible light (e.g. phosphor), coatings used to enhance secondary emissions and coatings used to prevent erosion. One skilled in the art will recognize that other coatings may also be used. The coatings 300 may be applied to the shell 50 by differential stripping, lithographic process, sputtering, laser deposition, chemical deposition, vapor deposition, or deposition using ink jet technology. One skilled in the art will realize that other methods of coating the inside and/or outside of the shell 50 may be used. Types of dopants include, but are not limited to, dopants used to convert UV light to visible light (e.g., phosphor), dopants used to enhance secondary emissions and dopants used to provide a conductive path through the shell 50. The dopants are added to the shell 50 by any suitable technique known to one skilled in the art, including ion implantation. It is contemplated that any combination of coatings and dopants may be added to a micro-component 40. Alternatively, or in combination with the coatings and dopants that may be added to a micro-component 40, a variety of coatings 350 may be coated on the inside of a socket 30. These coatings 350 include, but are not limited to, coatings used to convert UV light to visible light, coatings used as reflecting filters, and coatings used as band-gap filters.

In an embodiment of the present invention, when a micro-component is configured to emit UV light, the UV light is converted to visible light by at least partially coating the inside the shell 50 with phosphor, at least partially coating the outside of the shell 50 with phosphor, doping the shell 50 with phosphor and/or coating the inside of a socket 30 with phosphor. In a color panel, according to an embodiment of the present invention, colored phosphor is chosen so the visible light emitted from alternating micro-components is colored red, green and blue, respectively. By combining these primary colors at varying intensities, all colors can be formed. It is contemplated that other color combinations and arrangements may be used. In another embodiment for a color light-emitting panel, the UV light is converted to visible light by disposing a single colored phosphor on the micro-component 40 and/or on the inside of the socket 30. Colored filters may then be alternatingly applied over each socket 30 to convert the visible light to colored light of any suitable arrangement, for example red, green and blue. By coating all the micro-components with a single colored phosphor and then converting the visible light to colored light by using at least one filter applied over the top of each socket, micro-component placement is made less complicated and the light-emitting panel is more easily configurable.

To obtain an increase in luminosity and radiation transport efficiency, in an embodiment of the present invention, the shell 50 of each micro-component 40 is at least partially coated with a secondary emission enhancement material. Any low affinity material may be used including, but not limited to, magnesium oxide and thulium oxide. One skilled in the art would recognize that other materials will also provide secondary emission enhancement. In another embodiment of the present invention, the shell 50 is doped with a secondary emission enhancement material. It is contemplated that the doping of shell 50 with a secondary emission enhancement material may be in addition to coating the shell 50 with a secondary emission enhancement material. In this case, the secondary emission enhancement material used to coat the shell 50 and dope the shell 50 may be different.

In addition to, or in place of, doping the shell 50 with a secondary emission enhancement material, according to an embodiment of the present invention, the shell 50 is doped with a conductive material. Possible conductive materials include, but are not limited to silver, gold, platinum, and aluminum. Doping the shell 50 with a conductive material provides a direct conductive path to the gas or gas mixture contained in the shell and provides one possible means of achieving a DC light-emitting panel.

In another embodiment of the present invention, the shell 50 of the micro-component 40 is coated with a reflective material. An index matching material that matches the index of refraction of the reflective material is disposed so as to be in contact with at least a portion of the reflective material. The reflective coating and index matching material may be separate from, or in conjunction with, the phosphor coating and secondary emission enhancement coating of previous embodiments. The reflective coating is applied to the shell 50 in order to enhance radiation transport. By also disposing an index-matching material so as to be in contact with at least a portion of the reflective coating, a predetermined wavelength range of radiation is allowed to escape through the reflective coating at the interface between the reflective coating and the index-matching material. By forcing the radiation out of a micro-component through the interface area between the reflective coating and the index-matching material greater micro-component efficiency is achieved with an increase in luminosity. In an embodiment, the index matching material is coated directly over at least a portion of the reflective coating. In another embodiment, the index matching material is disposed on a material layer, or the like, that is brought in contact with the micro-component such that the index matching material is in contact with at least a portion of the reflective coating. In another embodiment, the size of the interface is selected to achieve a specific field of view for the light-emitting panel.

A cavity 55 formed within and/or on the first substrate 10 provides the basic socket 30 structure. The cavity 55 may be any shape and size. As depicted in FIGS. 3A–3J, the shape of the cavity 55 may include, but is not limited to, a cube 100, a cone 110, a conical frustum 120, a paraboloid 130, spherical 140, cylindrical 150, a pyramid 160, a pyramidal frustum 170, a parallelepiped 180, or a prism 190.

Figure 4:
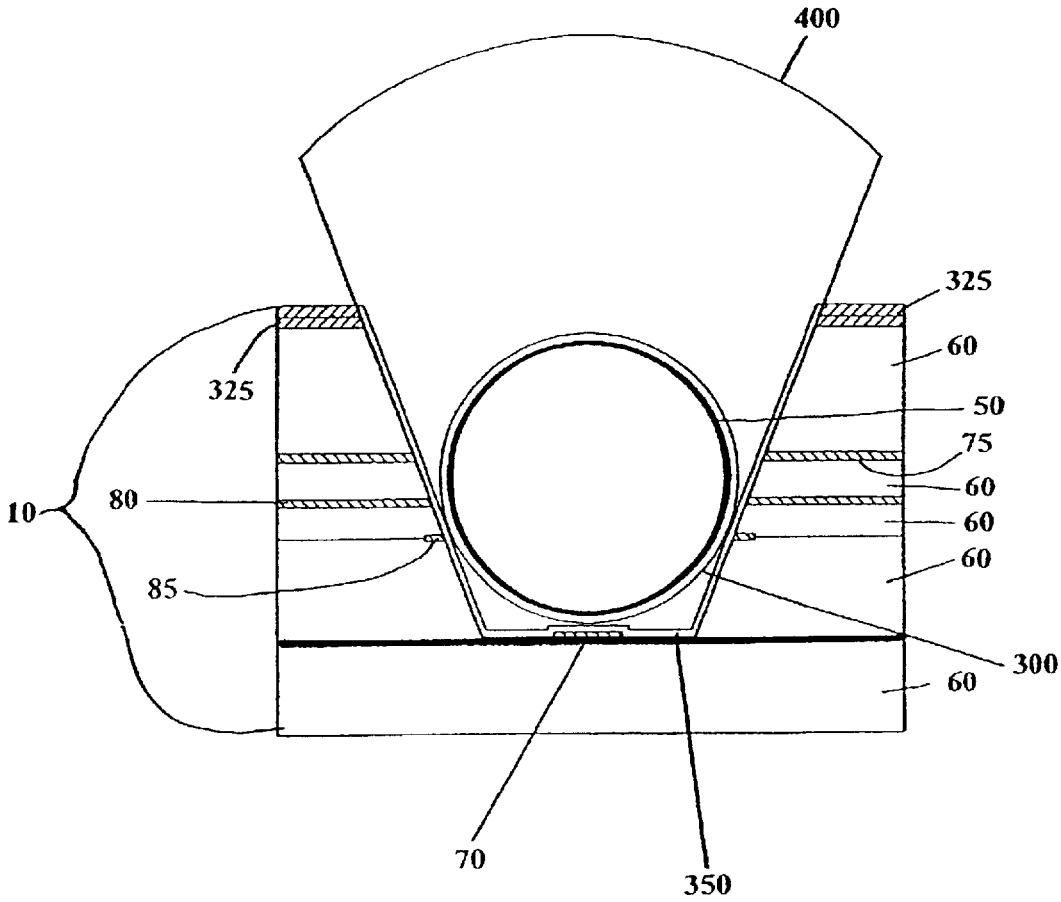
FIG. 4 shows the socket structure from a light-emitting panel of an embodiment of the present invention with a narrower field of view.
Figure 5:
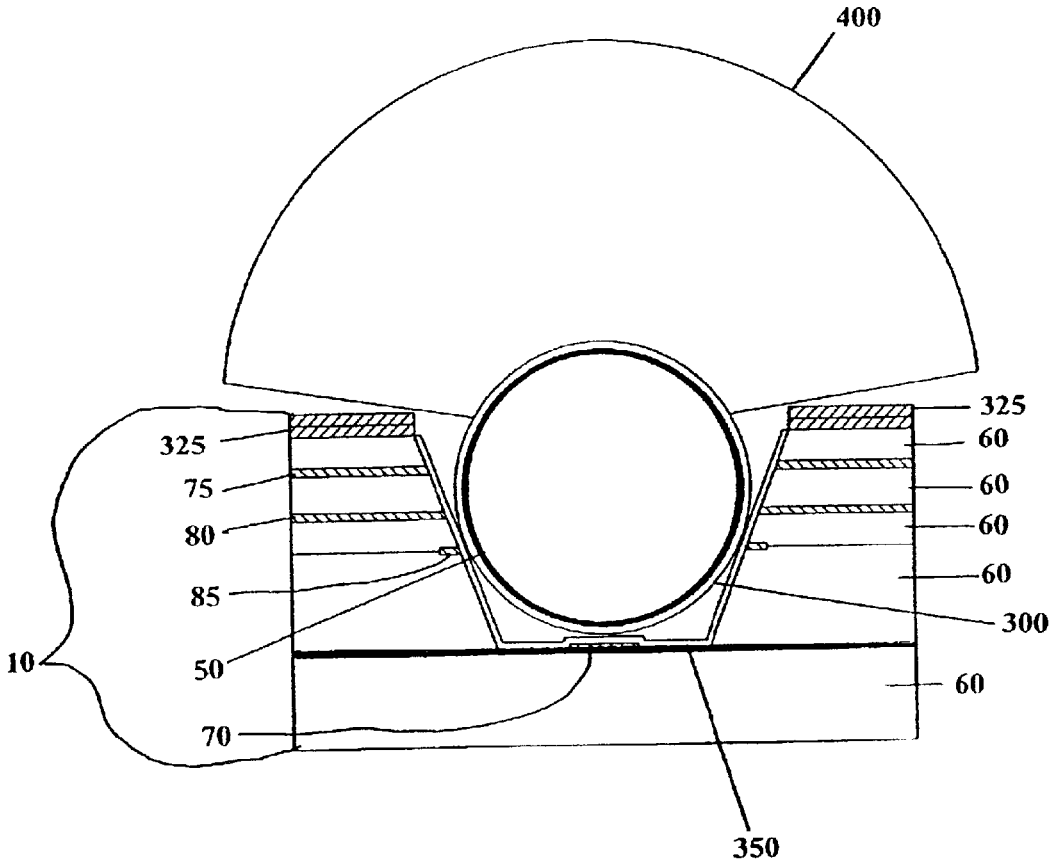
FIG. 5 shows the socket structure from a light-emitting panel of an embodiment of the present invention with a wider field of view.

The size and shape of the socket 30 influence the performance and characteristics of the light-emitting panel and are selected to optimize the panel's efficiency of operation. In addition, socket geometry may be selected based on the shape and size of the micro-component to optimize the surface contact between the micro-component and the socket and/or to ensure connectivity of the micro-component and any electrodes disposed within the socket. Further, the size and shape of the sockets 30 may be chosen to optimize photon generation and provide increased luminosity and radiation transport efficiency. As shown by example in FIGS. 4 and 5, the size and shape may be chosen to provide a field of view 400 with a specific angle θ, such that a micro-component 40 disposed in a deep socket 30 may provide more collimated light and hence a narrower viewing angle θ (FIG. 4), while a micro-component 40 disposed in a shallow socket 30 may provide a wider viewing angle θ (FIG. 5). That is to say, the cavity may be sized, for example, so that its depth subsumes a micro-component deposited in a socket, or it may be made shallow so that a micro-component is only partially disposed within a socket. Alternatively, in another embodiment of the present invention, the field of view 400 may be set to a specific angle θ by disposing on the second substrate at least one optical lens. The lens may cover the entire second substrate or, in the case of multiple optical lenses, arranged so as to be in register with each socket. In another embodiment, the optical lens or optical lenses are configurable to adjust the field of view of the light-emitting panel.

In an embodiment for a method of making a light-emitting panel including a plurality of sockets, a cavity 55 is formed, or patterned, in a substrate 10 to create a basic socket shape. The cavity may be formed in any suitable shape and size by any combination of physically, mechanically, thermally, electrically, optically, or chemically deforming the substrate. Disposed proximate to, and/or in, each socket may be a variety of enhancement materials 325. The enhancement materials 325 include, but are not limited to, anti-glare coatings, touch sensitive surfaces, contrast enhancement (black mask) coatings, protective coatings, transistors, integrated-circuits, semiconductor devices, inductors, capacitors, resistors, control electronics, drive electronics, diodes, pulse-forming networks, pulse compressors, pulse transformers, and tuned-circuits.

In another embodiment of the present invention for a method of making a light-emitting panel including a plurality of sockets, a socket 30 is formed by disposing a plurality of material layers 60 to form a first substrate 10, disposing at least one electrode either directly on the first substrate 10, within the material layers or any combination thereof, and selectively removing a portion of the material layers 60 to create a cavity. The material layers 60 include any combination, in whole or in part, of dielectric materials, metals, and enhancement materials 325. The enhancement materials 325 include, but are not limited to, anti-glare coatings, touch sensitive surfaces, contrast enhancement (black mask) coatings, protective coatings, transistors, integrated-circuits, semiconductor devices, inductors, capacitors, resistors, control electronics, drive electronics, diodes, pulse-forming networks, pulse compressors, pulse transformers, and tuned-circuits. The placement of the material layers 60 may be accomplished by any transfer process, photolithography, xerographic-type processes, plasma deposition, sputtering, laser deposition, chemical deposition, vapor deposition, or deposition using ink jet technology. One of general skill in the art will recognize other appropriate methods of disposing a plurality of material layers on a substrate. The cavity 55 may be formed in the material layers 60 by a variety of methods including, but not limited to, wet or dry etching, photolithography, laser heat treatment, thermal form, mechanical punch, embossing, stamping-out, drilling, electroforming or by dimpling.

In another embodiment of the present invention for a method of making a light-emitting panel including a plurality of sockets, a socket 30 is formed by patterning a cavity 55 in a first substrate 10, disposing a plurality of material layers 65 on the first substrate 10 so that the material layers 65 conform to the cavity 55, and disposing at least one electrode on the first substrate 10, within the material layers 65, or any combination thereof. The cavity may be formed in any suitable shape and size by any combination of physically, mechanically, thermally, electrically, optically, or chemically deforming the substrate. The material layers 60 include any combination, in whole or in part, of dielectric materials, metals, and enhancement materials 325. The enhancement materials 325 include, but are not limited to, anti-glare coatings, touch sensitive surfaces, contrast enhancement (black mask) coatings, protective coatings, transistors, integrated-circuits, semiconductor devices, inductors, capacitors, resistors, control electronics, drive electronics, diodes, pulse-forming networks, pulse compressors, pulse transformers, and tuned-circuits. The placement of the material layers 60 may be accomplished by any transfer process, photolithography, xerographic-type processes, plasma deposition, sputtering, laser deposition, chemical deposition, vapor deposition, or deposition using ink jet technology. One of general skill in the art will recognize other appropriate methods of disposing a plurality of material layers on a substrate.

In another embodiment of the present invention for a method of making a light-emitting panel including a plurality of sockets, a socket 30 is formed by disposing a plurality of material layers 66 on a first substrate 10 and disposing at least one electrode on the first substrate 10, within the material layers 66, or any combination thereof. Each of the material layers includes a preformed aperture 56 that extends through the entire material layer. The apertures may be of the same size or may be of different sizes. The plurality of material layers 66 are disposed on the first substrate with the apertures in alignment thereby forming a cavity 55. The material layers 66 include any combination, in whole or in part, of dielectric materials, metals, and enhancement materials 325. The enhancement materials 325 include, but are not limited to, anti-glare coatings, touch sensitive surfaces, contrast enhancement (black mask) coatings, protective coatings, transistors, integrated-circuits, semiconductor devices, inductors, capacitors, resistors, diodes, control electronics, drive electronics, pulse-forming networks, pulse compressors, pulse transformers, and tuned-circuits. The placement of the material layers 66 may be accomplished by any transfer process, photolithography, xerographic-type processes, plasma deposition, sputtering, laser deposition, chemical deposition, vapor deposition, or deposition using ink jet technology. One of general skill in the art will recognize other appropriate methods of disposing a plurality of material layers on a substrate.

In the above embodiments describing four different methods of making a socket in a light-emitting panel, disposed in, or proximate to, each socket may be at least one enhancement material. As stated above the enhancement material 325 may include, but is not limited to, antiglare coatings, touch sensitive surfaces, contrast enhancement (black mask) coatings, protective coatings, transistors, integrated-circuits, semiconductor devices, inductors, capacitors, resistors, control electronics, drive electronics, diodes, pulse-forming networks, pulse compressors, pulse transformers, and tuned-circuits. In a preferred embodiment of the present invention the enhancement materials may be disposed in, or proximate to each socket by any transfer process, photolithography, xerographic-type processes, plasma deposition, sputtering, laser deposition, chemical deposition, vapor deposition, deposition using ink jet technology, or mechanical means. In another embodiment of the present invention, a method for making a light-emitting panel includes disposing at least one electrical enhancement (e.g. the transistors, integrated-circuits, semiconductor devices, inductors, capacitors, resistors, control electronics, drive electronics, diodes, pulse-forming networks, pulse compressors, pulse transformers, and tuned-circuits), in, or proximate to, each socket by suspending the at least one electrical enhancement in a liquid and flowing the liquid across the first substrate. As the liquid flows across the substrate the at least one electrical enhancement will settle in each socket. It is contemplated that other substances or means may be use to move the electrical enhancements across the substrate. One such means may include, but is not limited to, using air to move the electrical enhancements across the substrate. In another embodiment of the present invention the socket is of a corresponding shape to the at least one electrical enhancement such that the at least one electrical enhancement self-aligns with the socket.

The electrical enhancements may be used in a light-emitting panel for a number of purposes including, but not limited to, lowering the voltage necessary to ionize the plasma-forming gas in a micro-component, lowering the voltage required to sustain/erase the ionization charge in a micro-component, increasing the luminosity and/or radiation transport efficiency of a micro-component, and augmenting the frequency at which a micro-component is lit. In addition, the electrical enhancements may be used in conjunction with the light-emitting panel driving circuitry to alter the power requirements necessary to drive the light-emitting panel. For example, a tuned-circuit may be used in conjunction with the driving circuitry to allow a DC power source to power an AC-type light-emitting panel. In an embodiment of the present invention, a controller is provided that is connected to the electrical enhancements and capable of controlling their operation. Having the ability to individually control the electrical enhancements at each pixel/subpixel provides a means by which the characteristics of individual micro-components may be altered/corrected after fabrication of the light-emitting panel. These characteristics include, but are not limited to, luminosity and the frequency at which a micro-component is lit. One skilled in the art will recognize other uses for electrical enhancements disposed in, or proximate to, each socket in a light-emitting panel.

The electrical potential necessary to energize a micro-component 40 is supplied via at least two electrodes. The electrodes may be disposed in the light-emitting panel using any technique know to one skilled in the art including, but not limited to, any transfer process, photolithography, xerographic-type processes, plasma deposition, sputtering, laser deposition, chemical deposition, vapor deposition, deposition using ink jet technology, or mechanical means. In a general embodiment of the present invention, a light-emitting panel includes a plurality of electrodes, wherein at least two electrodes are adhered to the first substrate, the second substrate or any combination thereof and wherein the electrodes are arranged so that voltage applied to the electrodes causes one or more micro-components to emit radiation. In another general embodiment, a light-emitting panel includes a plurality of electrodes, wherein at least two electrodes are arranged so that voltage supplied to the electrodes cause one or more micro-components to emit radiation throughout the field of view of the light-emitting panel without crossing either of the electrodes.

In an embodiment where the sockets 30 are patterned on the first substrate 10 so that the sockets are formed in the first substrate, at least two electrodes may be disposed on the first substrate 10, the second substrate 20, or any combination thereof. In exemplary embodiments as shown in FIGS. 1 and 2, a sustain electrode 70 is adhered on the second substrate 20 and an address electrode 80 is adhered on the first substrate 10. In a preferred embodiment, at least one electrode adhered to the first substrate 10 is at least partly disposed within the socket (FIGS. 1 and 2).

Figure 6A:
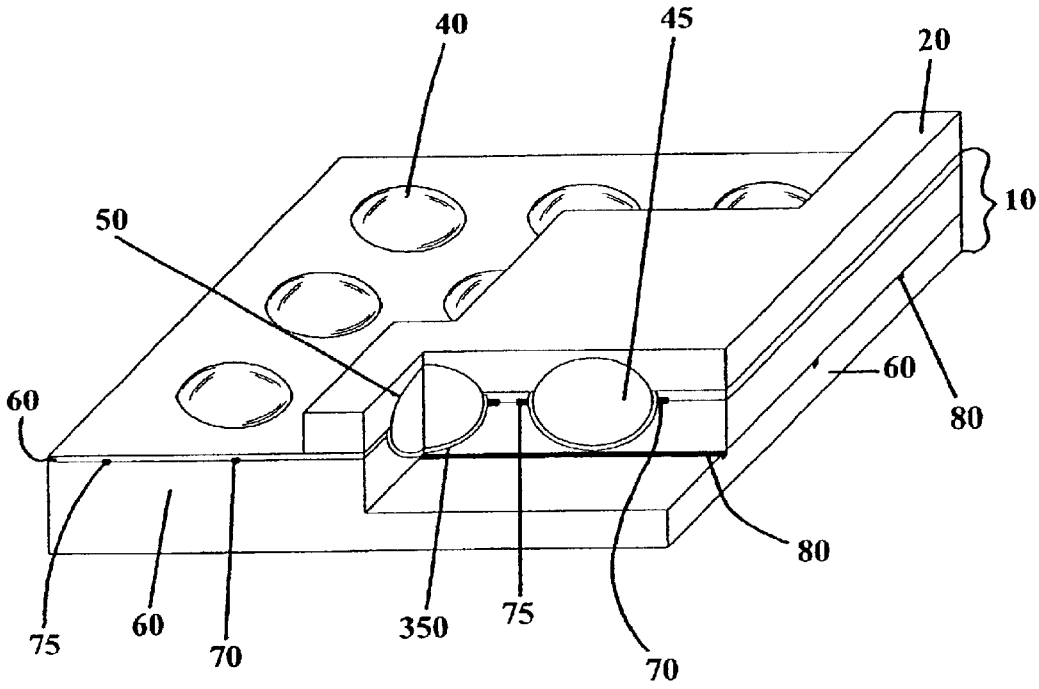
FIG. 6A depicts a portion of a light-emitting panel showing the basic socket structure of a socket formed from disposing a plurality of material layers and then selectively removing a portion of the material layers with the electrodes having a co-planar configuration.
Figure 6B:
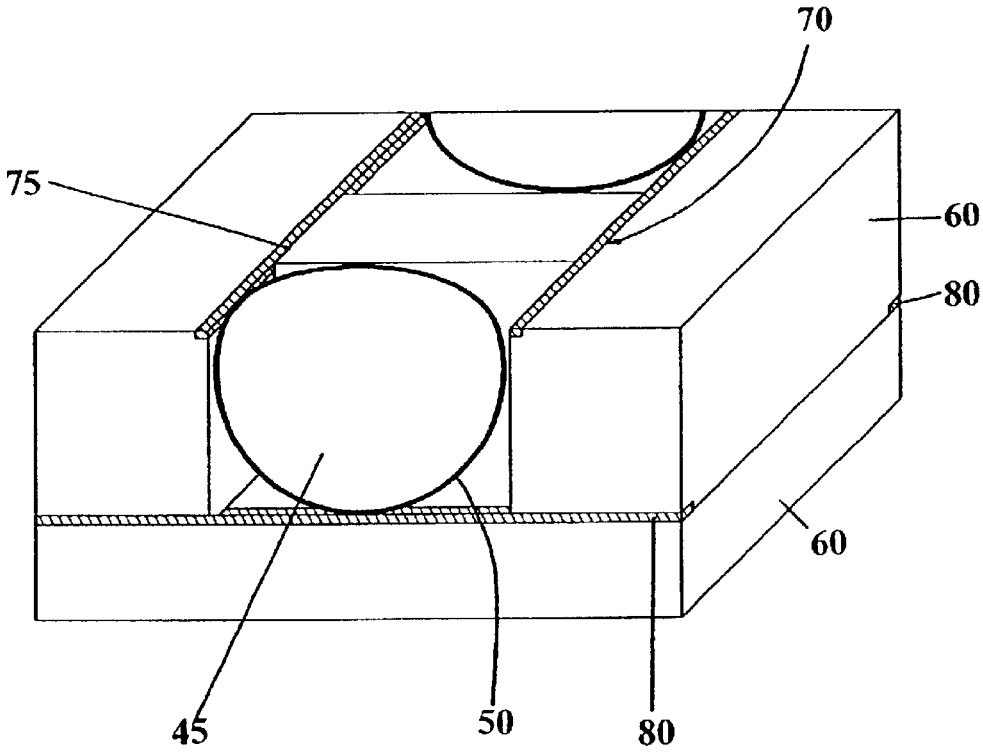
FIG. 6B is a cut-away of FIG. 6A showing in more detail the co-planar sustaining electrodes.
Figure 7A:
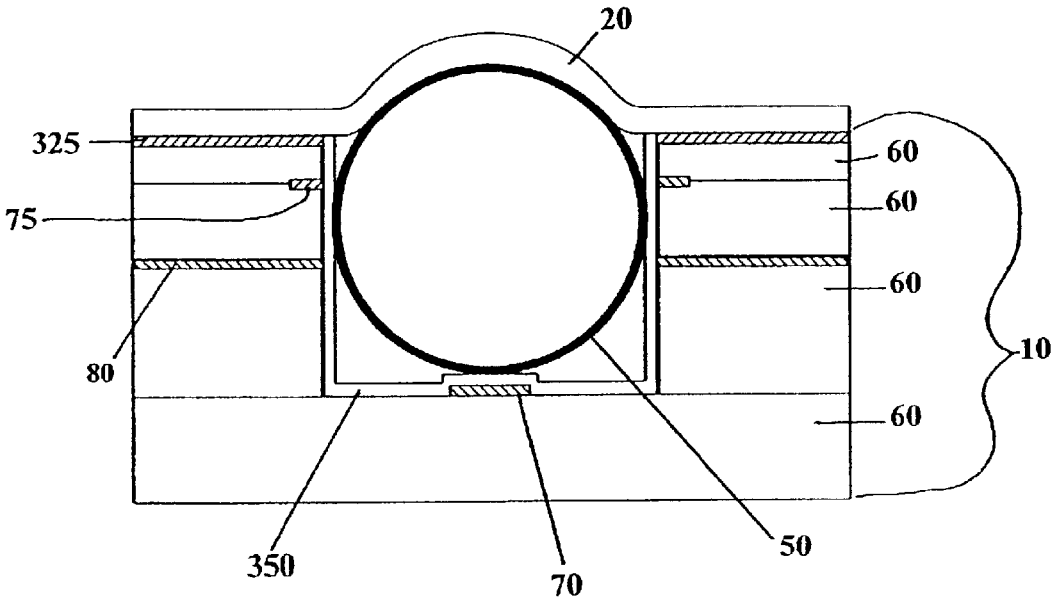
FIG. 7A depicts a portion of a light-emitting panel showing the basic socket structure of a socket formed from disposing a plurality of material layers and then selectively removing a portion of the material layers with the electrodes having a mid-plane configuration.
Figure 7B:
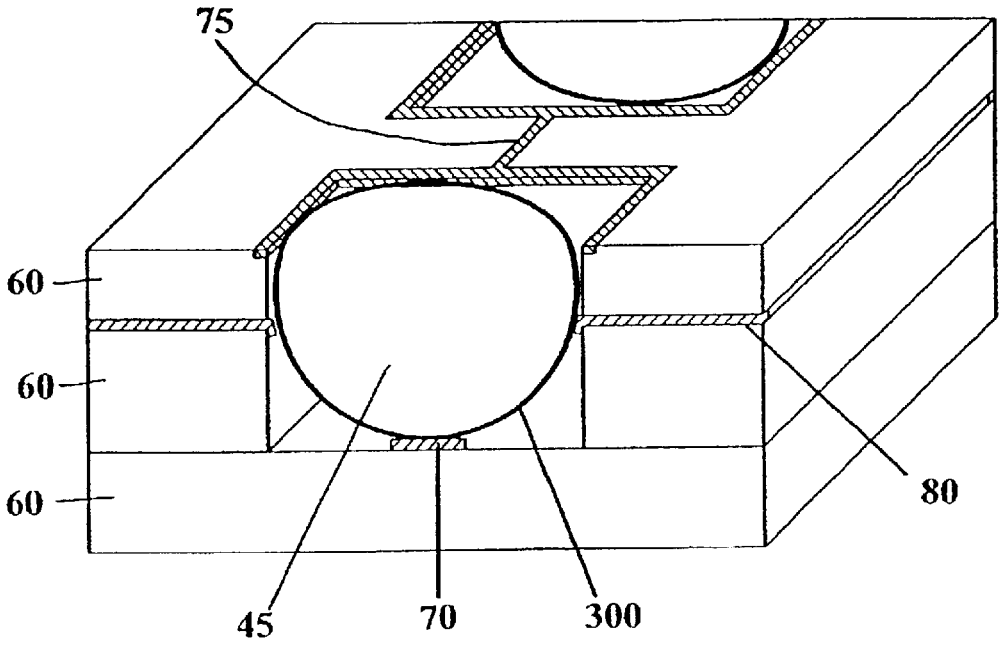
FIG. 7B is a cut-away of FIG. 7A showing in more detail the uppermost sustain electrode.
Figure 8:
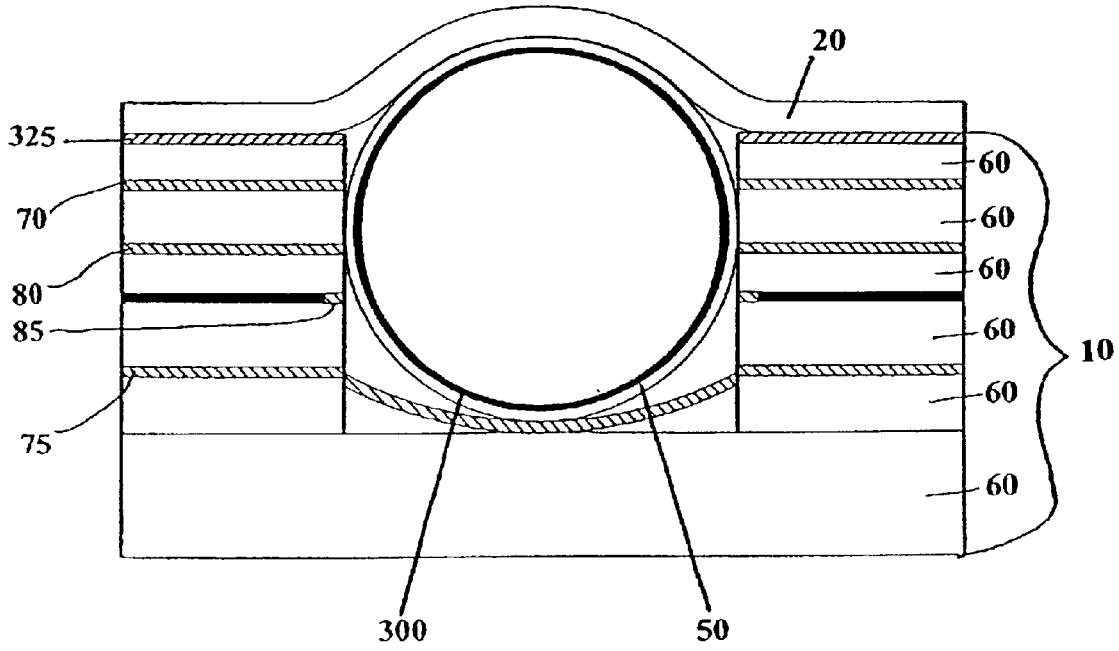
FIG. 8 depicts a portion of a light-emitting panel showing the basic socket structure of a socket formed from disposing a plurality of material layers and then selectively removing a portion of the material layers with the electrodes having an configuration with two sustain and two address electrodes, where the address electrodes are between the two sustain electrodes.

In an embodiment where the first substrate 10 includes a plurality of material layers 60 and the sockets 30 are formed within the material layers, at least two electrodes may be disposed on the first substrate 10, disposed within the material layers 60, disposed on the second substrate 20, or any combination thereof. In one embodiment, as shown in FIG. 6A, a first address electrode 80 is disposed within the material layers 60, a first sustain electrode 70 is disposed within the material layers 60, and a second sustain electrode 75 is disposed within the material layers 60, such that the first sustain electrode and the second sustain electrode are in a co-planar configuration. FIG. 6B is a cut-away of FIG. 6A showing the arrangement of the co-planar sustain electrodes 70 and 75. In another embodiment, as shown in FIG. 7A, a first sustain electrode 70 is disposed on the first substrate 10, a first address electrode 80 is disposed within the material layers 60, and a second sustain electrode 75 is disposed within the material layers 60, such that the first address electrode is located between the first sustain electrode and the second sustain electrode in a mid-plane configuration. FIG. 7B is a cut-away of FIG. 7A showing the first sustain electrode 70. As seen in FIG. 8, in a preferred embodiment of the present invention, a first sustain electrode 70 is disposed within the material layers 60, a first address electrode 80 is disposed within the material layers 60, a second address electrode 85 is disposed within the material layers 60, and a second sustain electrode 75 is disposed within the material layers 60, such that the first address electrode and the second address electrode are located between the first sustain electrode and the second sustain electrode.

Figure 9:
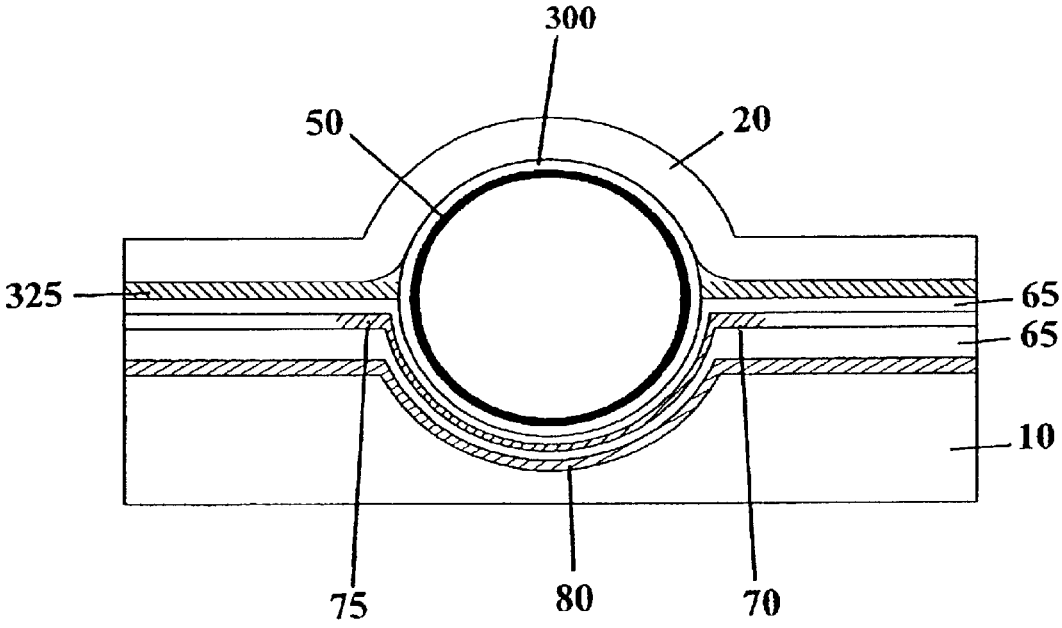
FIG. 9 depicts a portion of a light-emitting panel showing the basic socket structure of a socket formed from patterning a substrate and then disposing a plurality of material layers on the substrate so that the material layers conform to the shape of the cavity with the electrodes having a co-planar configuration.
Figure 10:
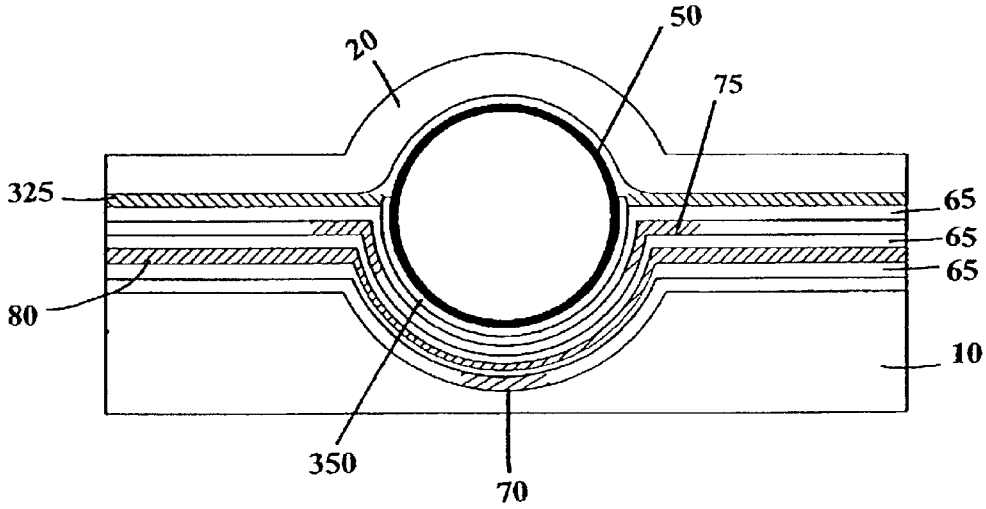
FIG. 10 depicts a portion of a light-emitting panel showing the basic socket structure of a socket formed from patterning a substrate and then disposing a plurality of material layers on the substrate so that the material layers conform to the shape of the cavity with the electrodes having a mid-plane configuration.
Figure 11:
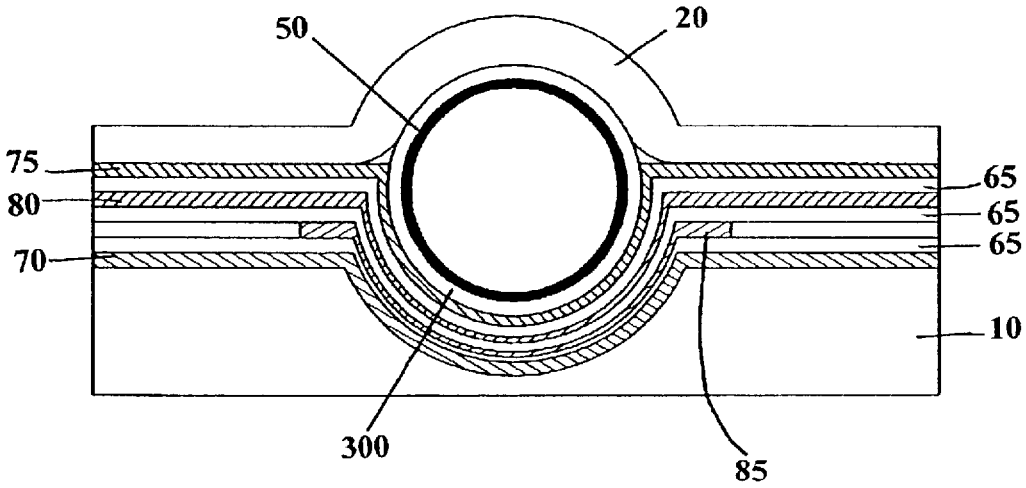
FIG. 11 depicts a portion of a light-emitting panel showing the basic socket structure of a socket formed from patterning a substrate and then disposing a plurality of material layers on the substrate so that the material layers conform to the shape of the cavity with the electrodes having an configuration with two sustain and two address electrodes, where the address electrodes are between the two sustain electrodes.

In an embodiment where a cavity 55 is patterned on the first substrate 10 and a plurality of material layers 65 are disposed on the first substrate 10 so that the material layers conform to the cavity 55, at least two electrodes may be disposed on the first substrate 10, at least partially disposed within the material layers 65, disposed on the second substrate 20, or any combination thereof. In one embodiment, as shown in FIG. 9, a first address electrode 80 is disposed on the first substrate 10, a first sustain electrode 70 is disposed within the material layers 65, and a second sustain electrode 75 is disposed within the material layers 65, such that the first sustain electrode and the second sustain electrode are in a co-planar configuration. In another embodiment, as shown in FIG. 10, a first sustain electrode 70 is disposed on the first substrate 10, a first address electrode 80 is disposed within the material layers 65, and a second sustain electrode 75 is disposed within the material layers 65, such that the first address electrode is located between the first sustain electrode and the second sustain electrode in a mid-plane configuration. As seen in FIG. 11, in a preferred embodiment of the present invention, a first sustain electrode 70 is disposed on the first substrate 10, a first address electrode 80 is disposed within the material layers 65, a second address electrode 85 is disposed within the material layers 65, and a second sustain electrode 75 is disposed within the material layers 65, such that the first address electrode and the second address electrode are located between the first sustain electrode and the second sustain electrode.

Figure 14:
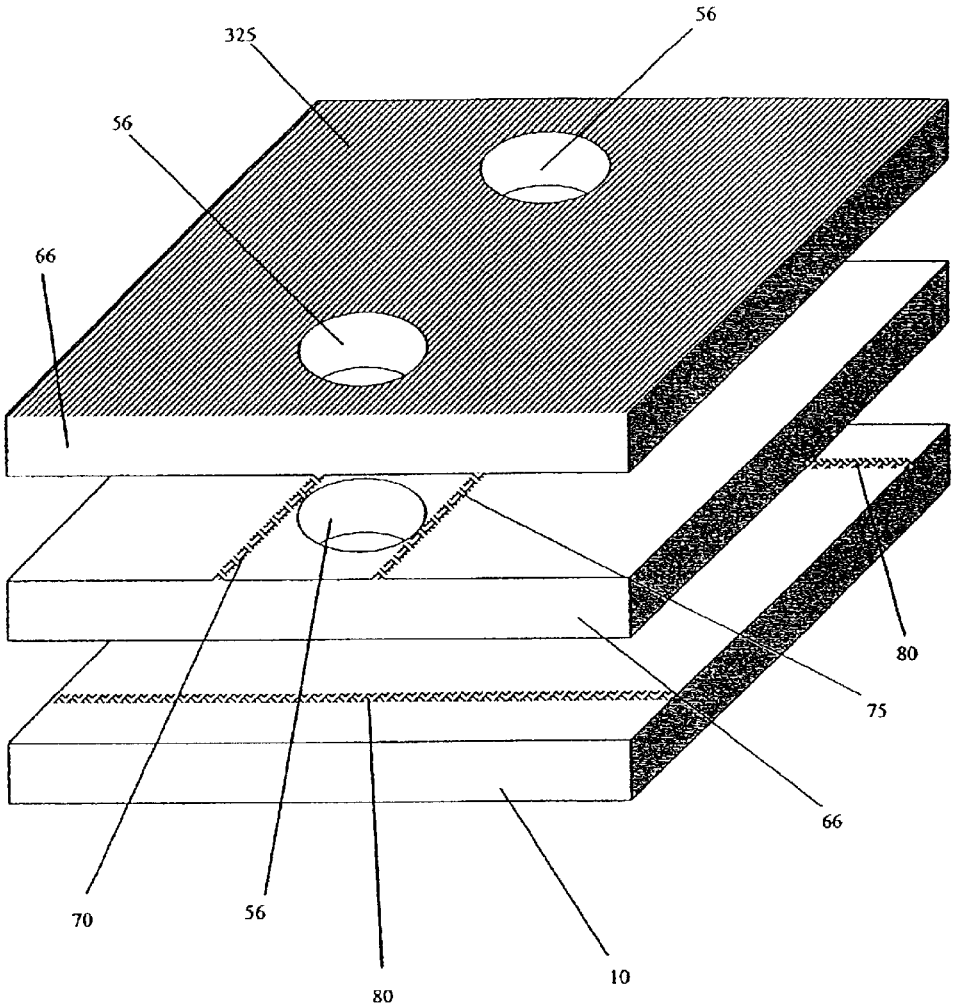
FIG. 14 shows an exploded view of a portion of a light-emitting panel showing the basic socket structure of a socket formed by disposing a plurality of material layers with aligned apertures on a substrate with the electrodes having a co-planar configuration.
Figure 15:
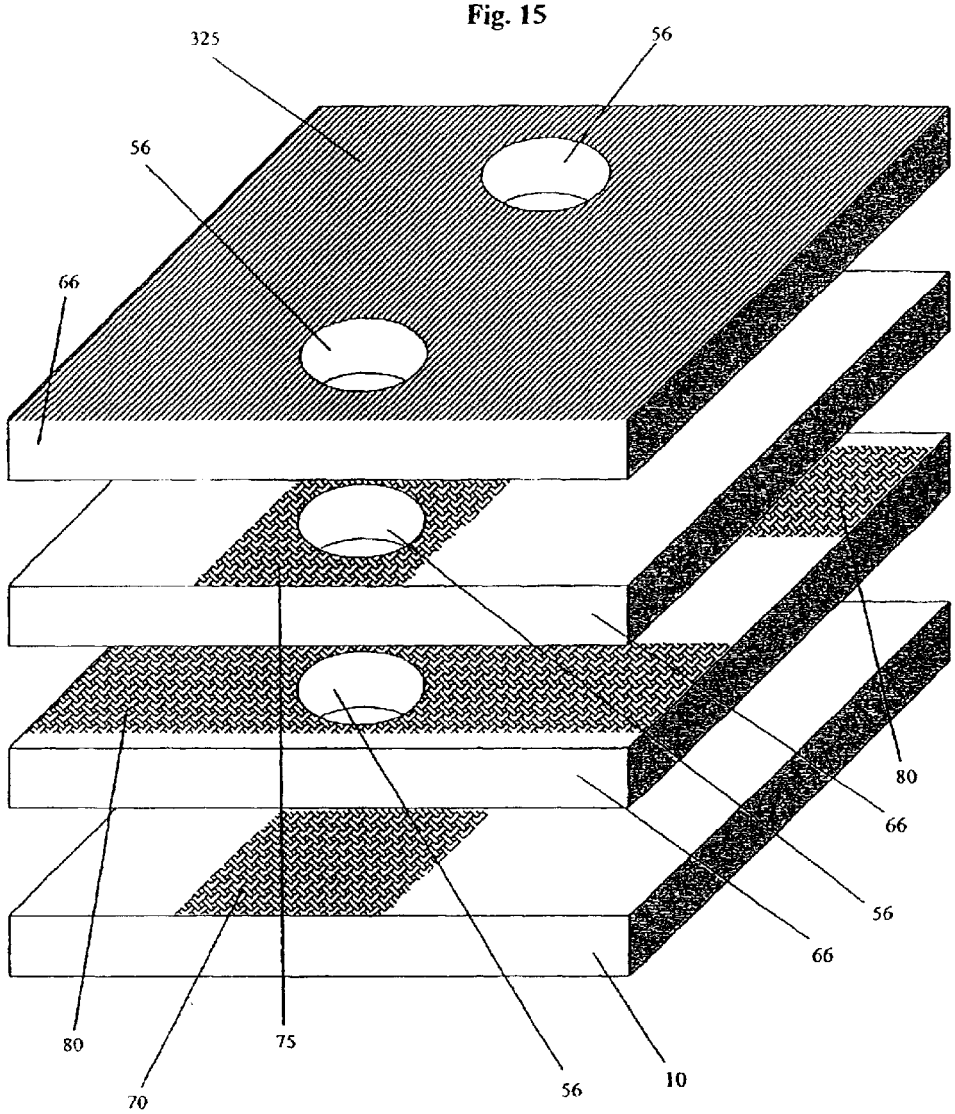
FIG. 15 shows an exploded view of a portion of a light-emitting panel showing the basic socket structure of a socket formed by disposing a plurality of material layers with aligned apertures on a substrate with the electrodes having a mid-plane configuration.
Figure 16:
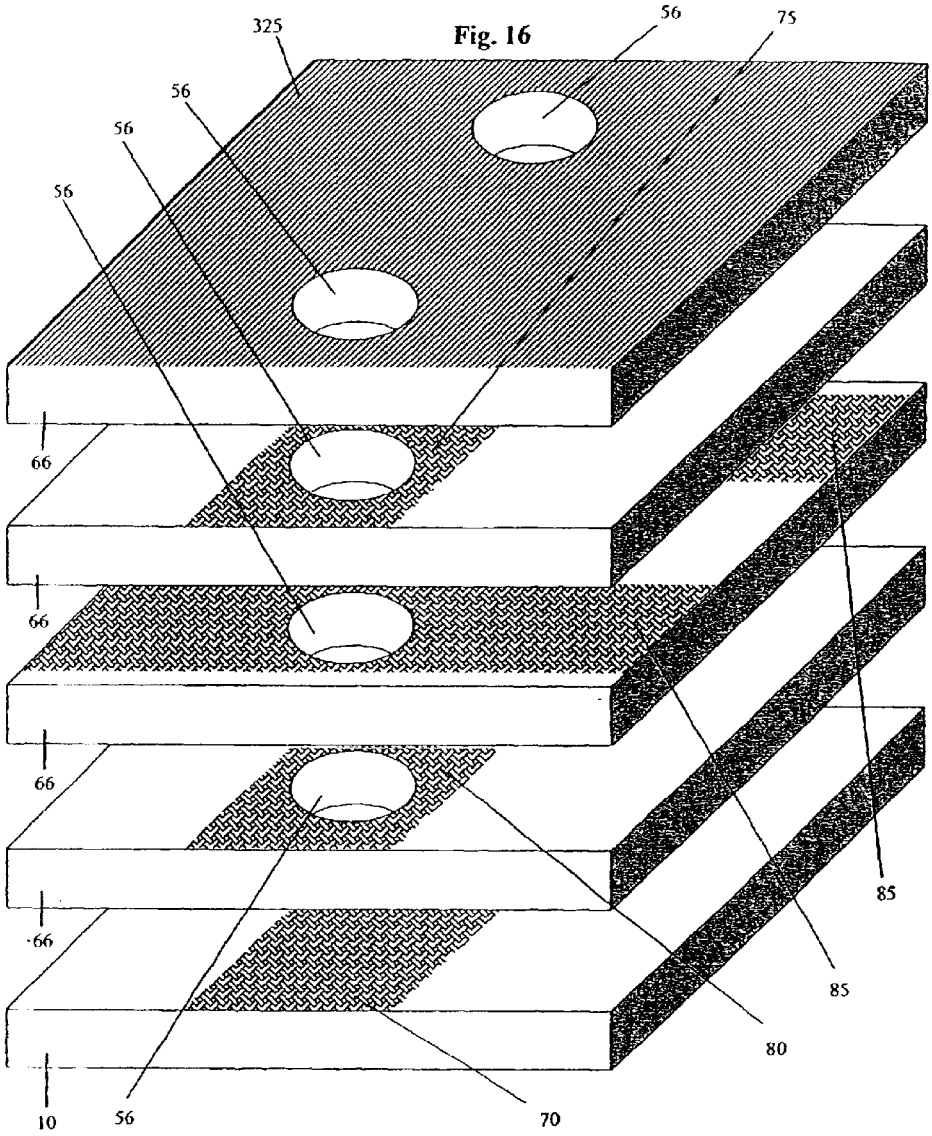
FIG. 16 shows an exploded view of a portion of a light-emitting panel showing the basic socket structure of a socket formed by disposing a plurality of material layers with aligned apertures on a substrate with electrodes having a configuration with two sustain and two address electrodes, where the address electrodes are between the two sustain electrodes.

In an embodiment where a plurality of material layers 66 with aligned apertures 56 are disposed on a first substrate 10 thereby creating the cavities 55, at least two electrodes may be disposed on the first substrate 10, at least partially disposed within the material layers 65, disposed on the second substrate 20, or any combination thereof. In one embodiment, as shown in FIG. 14, a first address electrode 80 is disposed on the first substrate 10, a first sustain electrode 70 is disposed within the material layers 66, and a second sustain electrode 75 is disposed within the material layers 66, such that the first sustain electrode and the second sustain electrode are in a co-planar configuration. In another embodiment, as shown in FIG. 15, a first sustain electrode 70 is disposed on the first substrate 10, a first address electrode 80 is disposed within the material layers 66, and a second sustain electrode 75 is disposed within the material layers 66, such that the first address electrode is located between the first sustain electrode and the second sustain electrode in a mid-plane configuration. As seen in FIG. 16, in a preferred embodiment of the present invention, a first sustain electrode 70 is disposed on the first substrate 10, a first address electrode 80 is disposed within the material layers 66, a second address electrode 85 is disposed within the material layers 66, and a second sustain electrode 75 is disposed within the material layers 66, such that the first address electrode and the second address electrode are located between the first sustain electrode and the second sustain electrode.

Figure 13:
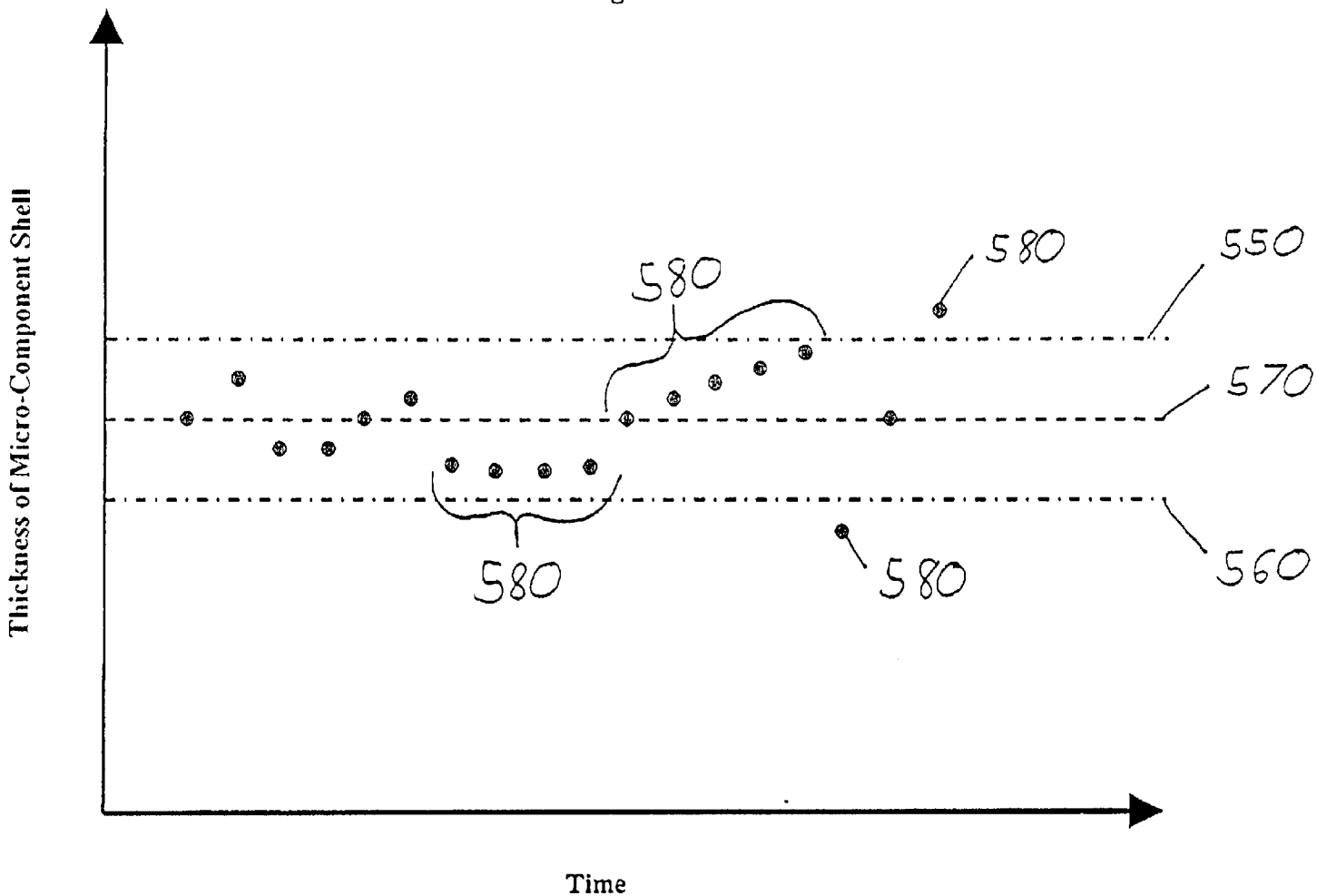
FIG. 13 is an example of data taken and stored after one of the fabrication process steps as described in an embodiment of the present invention.

According to one embodiment of the present invention, a process for testing a plurality of light-emitting panels comprises manufacturing a plurality of light-emitting panels in a web fabrication process. The web fabrication process includes a series of process steps and a plurality of component parts, as described in this application. A portion of a light-emitting panel is tested after one or more of the process steps. Data from the testing is processed and the results are analyzed to determine whether the results are within a specific target range of acceptable values for the portion of the light-emitting panel being tested. If the results are within acceptable ranges then no action is taken. If, however, the results fall outside the target range, then the results are used to adjust at least one of the process steps of the web fabrication process to bring the fabrication process back within acceptable tolerances. Although this embodiment contemplates at least one portion of a light-emitting panel being tested each time a process step is performed, it is contemplated in another embodiment that testing be performed at larger intervals. That is to say, by way of a non-limiting example, that it is contemplated that an electrode disposed as part of an electrode printing process may be tested either after each time the electrode printing process is performed or after every fifth time the electrode printing process is performed. It is also contemplated, in another embodiment of the present invention, that testing results may either be immediately used to adjust at least one process step of the manufacturing process and/or at least one component part of the light-emitting panel or the testing results may be stored. In the former case, as already described above, the testing results are analyzed to determine whether the results fall within a target range of acceptable values. If the results are acceptable no action is taken, however, if the results fall outside the target range, at least one process step and/or at least one component part is adjusted according to the results to bring the manufacturing process back within acceptable tolerances. In the latter case, the stored testing results are analyzed to determine whether a pattern of consistent non-conformity exists. FIG. 13 shows an example of data taken after the micro-component forming process regarding the thickness of the micro-component shell. The data was taken after each micro-component forming process operation and stored. FIG. 13 shows the upper target limit 550, the lower target limit 560 and the target value 570. In addition, FIG. 13 shows various non-limiting examples of what may constitute consistent non-conforming results 580. If it is determined that a pattern of consistent non-conformity 580 exists then at least one process step and/or at least one component part is adjusted according to the analyzed results to bring the manufacturing process back within acceptable tolerances. If there is no consistent non-conformity then no action is taken. It is worth noting that it is contemplated that adjustments to process steps and/or component parts may be made manually or automatically.

Figure 12:
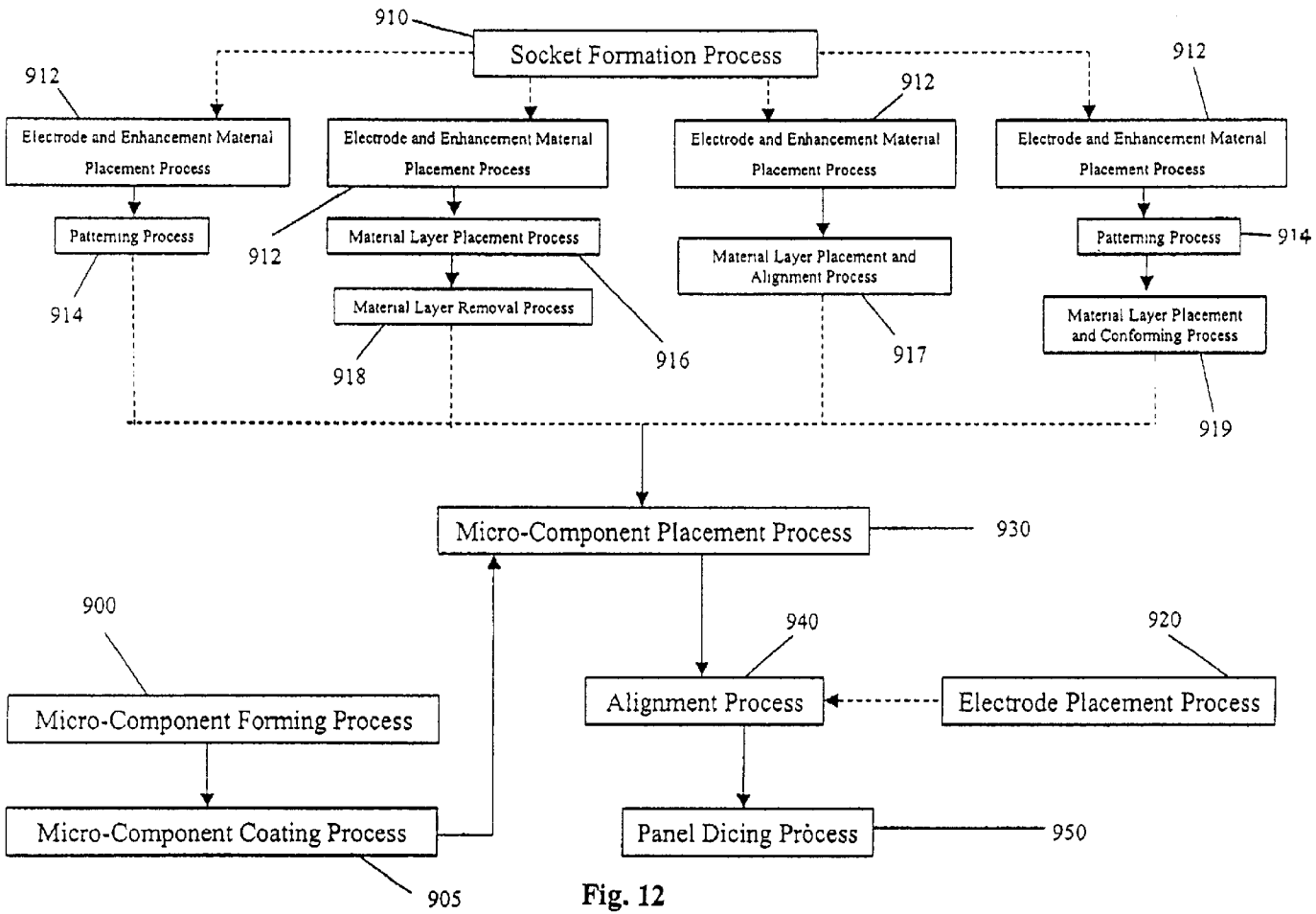
FIG. 12 is a flowchart describing a web fabrication method for manufacturing light-emitting panels and depicting various points throughout the method at which testing would take place as described in an embodiment of the present invention.

The application, above, has described, among other things, various components of a light-emitting panel and methodologies to make those components and to make a light-emitting panel. In an embodiment of the present invention, it is contemplated that those components may be manufactured and those methods for making may be accomplished as part of web fabrication process for manufacturing light-emitting panels. In another embodiment, as shown in FIG. 12, a web fabrication process for manufacturing light-emitting panels includes the following process steps: a micro-component forming process 900; a socket formation process 910; an electrode placement process 920; a micro-component placement process 930; an alignment process 940; and a panel dicing process 950. It should be made clear that the process steps may be performed in any suitable order. For example, the micro-component coating process 905 can occur either before the micro-component placement process 930 or after the micro-component placement process 930 for partial coating of the micro-components after placement in the sockets. Also where suitable, process steps may be performed in conjunction with other process steps such that two or more process steps are performed simultaneously. Furthermore, it is contemplated that two or more process steps may be combined into a single process step. Unless otherwise noted in this application, a testing method used to test a characteristic of a component part may be used regardless of what component part is being tested. That is to say, unless otherwise noted, that the testing method is related to the characteristic being tested not the component part. Therefore, unless otherwise noted, testing methods for similar characteristics will not be repeatedly discussed.

During the micro-component forming process 900, at least one micro-component is formed and at least partially filled with a plasma-producing gas. In another embodiment of the present invention, the micro-component forming process 900 also includes a micro-component coating process 905. The micro-component coating process 905 may occur at any suitable place during or after the micro-component forming process 900. After the micro-component forming process 900, inline testing is performed on at least one micro-component. The characteristics of the one or more micro-components that may be tested include, but are not limited to, size, shape, impedance, gas composition and pressure, and shell thickness. The size of the micro-component may be tested using image capture, process, and analysis, laser acoustic analysis, expert system analysis or another method known to one of skill in the art. The shape of the micro-component may be tested using image capture, process and analysis, or another method known to one of skill in the art. The impedance of the micro-component, in the case where the micro-component shell is doped with a conductive material, may be tested using microwave excitation or another method known to one of skill in the art. The gas composition and pressure of the micro-component may be tested using microwave excitation and intensity measurements, ultraviolet spectral analysis or another method known to one of skill in the art. The shell thickness of the micro-component may be tested interferometricly, using laser analysis or using another method known to one of skill in the art. It is contemplated, in an embodiment, that preformed micro-components with/without coatings may be used in the web fabrication process thereby alleviating the need for a micro-component forming process 900 or micro-component coating process 905.

During the socket formation process 910, according to an embodiment, a plurality of sockets 30 are formed within or on a first substrate 10. According to one embodiment, the socket formation process 910 includes an electrode and enhancement material placement process 912 and a patterning process 914. In another embodiment, the socket formation process 910 includes an electrode and enhancement material placement process 912, a material layer placement process 916, and a material layer removal process 918. In another embodiment, the socket formation process 910 includes an electrode and enhancement material placement process 912, a patterning process 914, and a material layer placement and conforming process 919. In another embodiment, the socket formation process 910 includes an electrode and enhancement material placement process 912 and a material layer placement and alignment process 917.

After the socket formation process 910, inline testing is performed on at least one socket. It is contemplated that since each embodiment of the socket formation process 910 includes a plurality of process steps that the inline testing may be performed after each of the process steps as opposed to inline testing after the socket is completely formed. After the electrode and enhancement material placement process 912, inline testing is performed on at least one electrode and/or at least one enhancement material. The characteristics of the one or more electrodes and/or the one or more enhancement materials that may be tested include, but are not limited to, placement, impedance, size, shape, material properties and enhancement material functionality. The placement of the electrode and/or enhancement material may be tested using image capture, process and analysis or another method known to one of skill in the art. The impedance of the electrode and/or enhancement material, when applicable, may be tested using standard time domain analysis or another method known to one of skill in the art. The material properties of the electrode and/or enhancement material may be tested using light transmission and intensity measurements, expert system analysis, image capture, process and analysis, laser acoustic analysis or another method known to one of skill in the art. After the patterning process 914, inline testing is performed on at least one cavity. The characteristics of the one or more cavities that may be tested include, but are not limited to, placement, impedance, size, shape, depth, wall quality and edge quality. The depth of the cavity may be tested using image capture, process and analysis, laser scanning and profiling, position-spatial frequency or another method known to one of skill in the art. After the material layer placement process 916, inline testing is performed on at least one material layer. The characteristics of the one or more material layers that may be tested include, but are not limited to, size, shape, thickness and material properties. After the material layer removal process 918, inline testing is preformed on at least one cavity formed in the plurality of material layers as a result of the material layer removal process. The characteristics of the one or more cavities includes, but is not limited to, size, shape, depth, wall quality and edge quality. After the material layer placement and conforming process 919, inline testing is performed on at least one material layer. The characteristics of the one or more material layers that may be tested include, but are not limited to, size, shape, thickness and material properties.

During the electrode placement process 920, at least one electrode and/or driving or control circuitry is disposed on or within the first substrate, on the second substrate, or any combination thereof. It is contemplated that the electrode placement process 920 may be performed as part of the electrode and enhancement material placement process 912 when an electrode is disposed on or within the first substrate or may be performed as a separate step when an electrode is disposed on the second substrate. After the electrode placement process 920, inline testing is performed on at least one electrode. The characteristics of the one or more electrodes that may be tested include, but are not limited to, placement, impedance, size, shape, material properties and electrical component functionality.

During the micro-component placement process 930, at least one micro-component is at least partially disposed in each socket. After the micro-component placement process 930, inline testing is performed on at least one micro-component. The characteristics of the one or more micro-components that may be tested include, but are not limited to, position and orientation. The position of the micro-component may be tested using image capture, process and analysis, expert system analysis, spatial frequency analysis or anther method known to one of skill in the art. The orientation of the micro-component may be tested using image capture, process and analysis, expert system analysis, or another method known to one of skill in the art. In an embodiment of the present invention where the light-emitting panels being manufactured are color light-emitting panels, the additional characteristic of whether a proper color micro-component is placed in the proper socket may also be tested by using ultraviolet excitation and visible color imaging or another method known to one of skill in the art.

During the alignment process 940, a second substrate 20 is positioned and placed, directly or indirectly, on the first substrate 10 so that one or more micro-components are sandwiched between the first and second substrates. After the alignment process 940, inline testing is performed on the second substrate. The characteristics of the second substrate that may be tested include, but are not limited to, position and orientation.

During the panel dicing process 960, the first and second "sandwiched" substrates are diced to form an individual light-emitting panel. After the dicing process 960, inline testing is performed on the individual light-emitting panel. The characteristics of the individual light-emitting panel that may be tested include, but are not limited to, size, shape and luminosity. The luminosity, in both visible and non-visible regions, of the light-emitting display may be tested by pixel-by-pixel image analysis.

Figure 17:
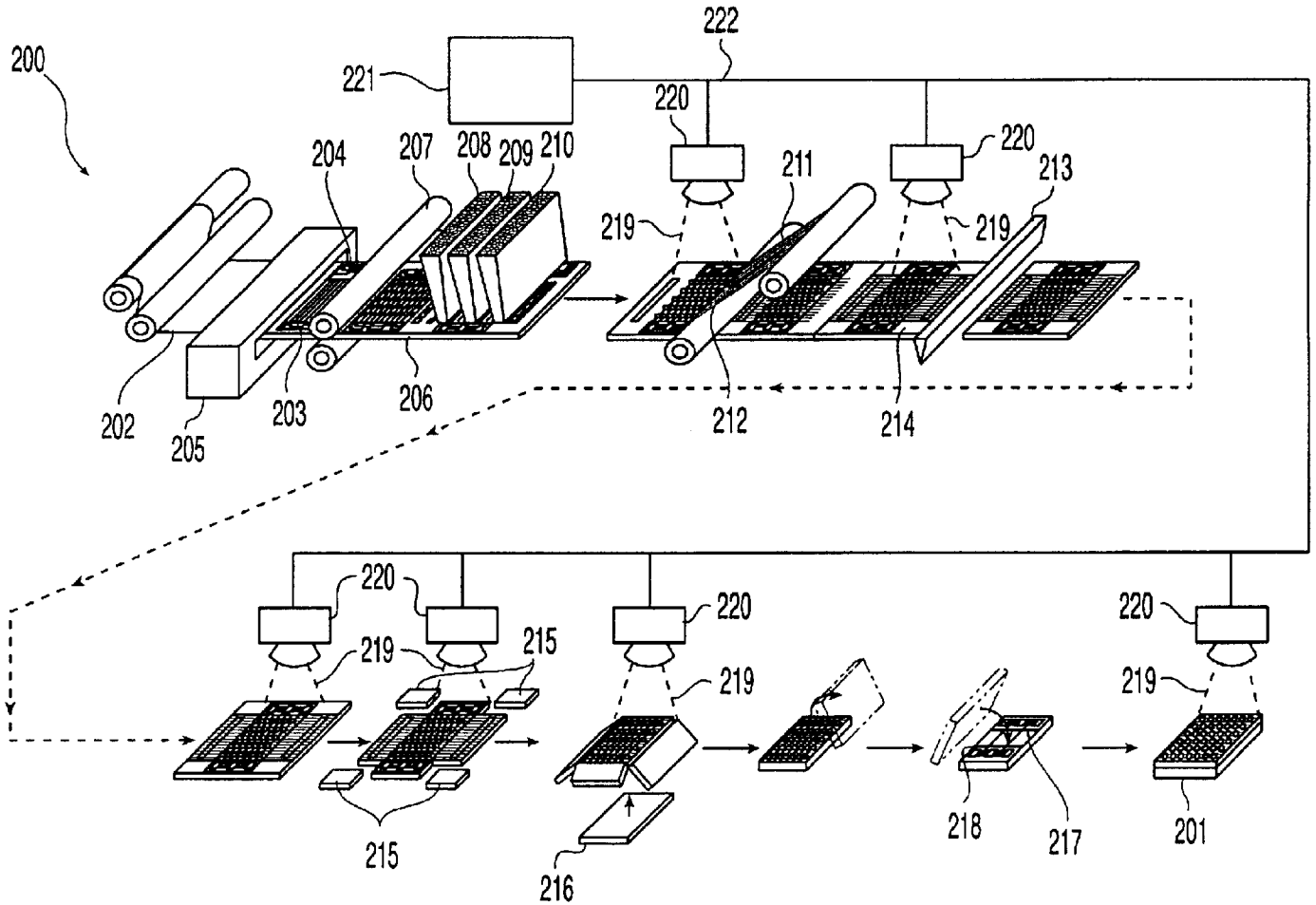
FIG. 17 is a schematic representation of a continuous fabrication process with on-line testing.

Although the on-line testing process of the present invention may be used to test or check various properties, conditions, or components of an assembled web, preferably, the method is used to test the functionality and the location of the micro-components. Referring to FIG. 17, an example of a continuous fabrication process is illustrated 200 in which testing of one or more micro-components 40 is accomplished on-line or in-line throughout the continuous fabrication process 200 used to make the light-emitting or plasma display panels 201 of the present invention. This on-line testing can also be used in other or alternative fabrication processes. Testing occurs at process speed and does not require any decrease in output or shutdown of the process. The flexible first substrate 202 of the present invention is introduced as a continuous web into the continuous fabrication process 200, and both control circuitry 203 and electrodes 204 are added to the flexible first substrate 202 at a printing station 205. Any suitable printing station 205 such as those known to one of ordinary skill in the art capable of adding the necessary control circuitry to the first substrate 202 are suitable.

A plurality of dimples, cavities or sockets 206 are then formed in the flexible first substrate 202 by any suitable mechanism such as a dimple forming roller 207, and either blue microspheres 208, red microspheres 209, or green microspheres 210 are introduced into the appropriate dimples 206 as desired. In one embodiment of placing additional dielectrics and electrodes in contact with the microspheres, a second flexible substrate 211 containing the appropriate dielectrics and electrodes 212 is then applied over the microspheres 208,209,210. Other methods can be used to apply the electrodes 212 such that the electrodes 212 are disposed on the first substrate 202, the second substrate 211, between or adjacent the substrates, or within material layers constituting the substrates. The electrodes 212 can be applied in combination with or independent of the second substrate 211.

The assembled web 214 is then cut to the desired size using a cutting mechanism 213 suitable for cutting the materials of the assembled web. To facilitate final assembly of the light-emitting panels 201, the corners 215 of the assembled web 214 are removed by conventional methods of assembled web fabrication, and the assembled web 214 is mounted to a structural member 216. Any additional circuitry 217 that is required or desired for operation of the final panel or display is added to the back 218 of the assembled web 214. This circuitry 217 includes conventional display circuitry known to one of skill in the art. Drive electronics, connectors, and any additional trim or packaging are then added to form the light-emitting panel 201.

On-line testing is used to test various properties of the assembled web, and ultimately the panels or light-emitting displays made from the assembled web and occurs at least once during the continuous fabrication process 200; however, since errors may occur throughout the fabrication process 200 due to reasons including physical damage to the microspheres, misplacement of the microspheres, absence of the microspheres, and malformation or misalignment of the control and drive circuitry, on-line testing is preferably performed at a plurality of points throughout the continuous fabrication process 200. For example, testing occurs after deposition or attachment of the micro-components 208,209, 210 into the dimples 206 in the first flexible substrate 202, after application of the second flexible substrate 211, after cutting of the assembled web 214 into smaller sections, after removal of the corners 215 of the assembled web 214, after attachment of the assembled web 214 to a structural member 216, or after complete assembly of the light-emitting panels 201. On-line testing is capable of handling the process speeds at which the manufacturing process is being operated. Typical process speeds are, for example, 10 cm of assembled web per second or one light-emitting display per 10 seconds. Alternatively, testing can be handled in a batch process by including accumulators (not shown) in the continuous fabrication process 200. The accumulators collect a portion of the assembled web for testing without slowing or stopping the entire process. By testing throughout the continuous fabrication process 200, points in the process that are resulting in defective product can be identified, defects in the assembled web or partially assembled web can be identified and rectified, waste can be minimized, and the light-emitting panel can be characterized in terms of individual micro-component performance for handling by post-production programming and operational control. Once corrective measures are taken, the assembled web 214 or light-emitting panel 201 can be retested to check that the corrective measures were effective.

As an initial step in order to test at least one selected micro-component 208,209,210 during the continuous fabrication process 200, at least a portion of the first flexible substrate 202 containing the microspheres 208,209,210, the assembled web 214, or the light-emitting panel 201 is passed within the field of view 219 of at least one luminous output or radiometric output measuring device 220. Alternatively, the entire assembled web 214 can be passed within the field of view. Suitable radiometric output measuring devices include high resolution electronic cameras such as digital cameras and CCD arrays arranged as both linear and area arrays. The radiometric measuring device 220 has a resolution sufficient to resolve an individual micro-component in the assembled web 214 and can analyze the assembled web 214 using either line imaging or area imaging. In one embodiment, the radiometric measuring device can produce a one-to-one map of up to three million micro-components in a selected assembled web 214. The radiometric measuring device 220 for a known excitation level can detect the presence or absence of a micro-component, can measure the amount or color of the light emitted, or can both detect the presence of a micro-component and measure its qualities; therefore, for each location in the continuous fabrication process 200 where testing is desired, either one radiometric measuring device capable of both detecting and measuring can be used or two radiometric measuring devices, one for detecting and one for measuring can be used.

Once the portion of the assembled web 214 to be tested is disposed within the field of view of the radiometric measuring device 220, either at least one, or for comparison purposes at least two micro-components, a plurality of selected micro-components or all of the micro-components on the assembled web 214, within the field of view 219 are excited to luminescence. Suitable methods for exciting the micro-components include exposing the assembled web 214 to a high electric field using a testing coil, exciting the micro-components using an electron or photon beam, exposing the micro-components to ultraviolet light, or using the existing arrangement of electrodes and control circuitry to excite the micro-components.

The radiation emitted from excited micro-components is detected by the radiometric measuring devices 220. The radiometric measuring devices deliver the measured properties of the selected micro-components including the presence or absence of luminescence, the color of the luminescence and the intensity of the luminescence to a central processor 221 to which all of the radiometric measuring devices 220 are connected by a communication network 222. The central processor 221 can analyze the data and log occurrences of errors. The central processor 221 can also be used to control each of the radiometric measuring devices 220.

When the existing circuitry is used in the test, the on-line testing also tests the components and connections in that circuitry. For example, the existing circuitry is used to address or excite selected micro-components in the assembled web as if the assembled web was being operated as a fully assembled light-emitting display or panel. Faulty circuitry would be indicated by a failure of the selected micro-component to emit radiation. This type of testing of the circuitry is enhanced by exciting the micro-components by a method other than the circuitry just prior to using the circuitry. Therefore, a faulty micro-component could be eliminated as the cause of the failure when the circuitry is used as the integrity and operation of the micro-component would be confirmed.

The properties of the micro-components are analyzed for problems or faults that require adjustment or attention. For example, if an entire section or large area of the assembled web is not functioning properly that section can be cut or removed from the assembled web 214. If a single micro-component is found to not be working, that micro-component can be removed and replaced with a new micro-component. Since the on-line testing method can check the color of each micro-component, if the color is incorrect, the faulty micro-component can be removed and replaced with another micro-component of the proper color. Alternatively, if a first micro-component having a first color is found to be transposed with a second micro-component having a second color, the first and second micro-components can be physically switched on the web. As an alternative to physically switching the first and second micro-components, the central processor can note the locations of the improperly placed micro-components and adjust the screen programming for that particular assembled web or light-emitting panel accordingly to compensate for the improper micro-component placement. Similarly, if one section of the assembled web is dimmer than surrounding sections, the central processor determines the screen programming necessary to compensate for the dimmer regions by increasing or decreasing the energy to the various micro-components or by varying the firing timing and sequencing of the micro-components to create a more uniform output. The necessary screen programming would then be included and utilized in the final assembled light-emitting display or panel. Therefore, the maximum amount of assembled web is utilized and waste is minimized. In addition, finished light-emitting panels that in the past would have been wasted can now be utilized.

In another embodiment of the present invention, the method of testing a light-emitting panel includes manufacturing a light-emitting panel in a series of process steps, testing at least one component part of the light-emitting panel after at least one process step, analyzing the test data to produce at least one result and utilizing the at least one result to adjust one or more component parts of the light-emitting panel. It is contemplated in this embodiment, however, that the adjustment may be zero (i.e. no adjustment) if the results show that the fabrication process is within specified tolerances. According to this embodiment, the series of process steps includes providing a first substrate, forming a plurality of cavities on or within the first substrate, placing at least one micro-component at least partially in each cavity, providing a second substrate opposed to the first substrate such that the at least one micro-component is sandwiched between the first and second substrates, disposing at least two electrodes so that voltage applied to the electrodes causes one or more micro-components to emit radiation. Testing may be performed on the first substrate, at least one cavity, at least one micro-component, at least one electrode, and/or the second substrate. Adjustments, after testing and analysis, may be made to the first substrate, the formation of the first substrate, the formation of the plurality of cavities, the plurality of cavities, the at least one micro-component, the disposition of at least one of the at least two electrodes, one or more electrodes, the placement of the second substrate and/or the second substrate.

Other embodiments and uses of the present invention will be apparent to those skilled in the art from consideration of this application and practice of the invention disclosed herein. The present description and examples should be considered exemplary only, with the true scope and spirit of the invention being indicated by the following claims. As will be understood by those of ordinary skill in the art, variations and modifications of each of the disclosed embodiments, including combinations thereof, can be made within the scope of this invention as defined by the following claims.

What is claimed is:

1. A method for on-line testing micro-components within an assembled web during continuous manufacturing of the assembled web, the method comprising:

passing at least a portion of the assembled web within a field of view of at least one radiometric output measuring device;

exciting at least one selected micro-component disposed on the assembled web within the field of view to luminescence;

detecting radiation emitted from the selected micro-component;

analyzing the detected radiation; and processing of the assembled web in accordance with the analysis.

2. A method for on-line testing micro-components within an assembled web during continuous manufacturing of the assembled web the method comprising:

passing at least a portion of the assembled web within a field of view of at least one radiometric output measuring device;

exciting at least one selected micro-component disposed on the assembled web within the field of view to luminescence by directing an electron beam to a selected ea of the assembled web;

detecting radiation emitted from the selected micro-component;

analyzing the detected radiation; and processing of the assembled web in accordance with the analysis.

3. The method of claim 1, wherein a plurality of selected micro-components are excited.

4. The method of claim 1, wherein the step of analyzing the detected radiation includes identifying an absence of luminescence from the selected micro-component.

5. The method of claim 4, further comprising disposing of the assembled web comprises removing sections of the assembled web containing the micro-component having no luminescence.

6. A method for on-line testing micro-components within an assembled web during continuous manufacturing of the assembled web the method comprising:

passing at least a portion of the assembled web within a field of view of at least one radiometric output measuring device;

exciting at least one selected micro-component disposed on the assembled web within the field of view to luminescence;

detecting radiation emitted from the selected micro-component;

analyzing the detected radiation by identifying an absence of luminescence from the selected micro-component; and processing of the assembled web in accordance with the analysis by disposing of the assembled web comprises removing the micro-component having no luminescence from the assembled web rid adding a replacement micro-component to the web at a location vacated by the removed micro-component.

7. The method of claim 1, wherein the step of analyzing the detected radiation comprises:

determining the existing or absence of radiation;

determining the color of the radiation; and, determining the intensity of the radiation.

8. A method for on-line testing micro-components within an assembled web during continuous manufacturing of the assembled web, the method comprising:

passing at least a portion of the assembled web within a field of view of at least one radiometric output measuring device;

exciting at least one selected micro-component disposed on the assembled web within the field of view to luminescence;

detecting radiation emitted from the selected micro-component;

analyzing the detected radiation including determining the existing or absence of radiation;

determining the color of the radiation;

determining the intensity of the radiation;

determining locations on the assembled web where a first colored micro-component is transposed within a second colored micro-component; and processing of the assembled web in accordance with the analysis by switching the first and second micro-components.

9. A method for on-line testing micro-components within an assembled web during continuous manufacturing of the assembled web, the method comprising:

passing at least a portion of the assembled web within a field of view of at least one radiometric output measuring device wherein the radiometric measuring device is a high resolution electronic camera;

exciting at least one selected micro-component disposed on the assembled web within the field of view to luminescence;

detecting radiation emitted from the selected micro-component;

analyzing the detected radiation; and processing of the assembled web in accordance with the analysis.

10. A method for on-line testing micro-components within an assembled web during continuous manufacturing of the assembled web, the method comprising:

passing at least a portion of the assembled web within a field of view of at least one radiometric output measuring device wherein the radiometric measuring device has a resolution sufficient to resolve a single micro-component in the assembled web;

exciting at least one selected micro-component disposed on the assembled web within the field of view to luminescence;

detecting radiation emitted from the selected micro-component;

analyzing the detected radiation; and processing of the assembled web in accordance with the analysis.

11. A method for on-line testing micro-components within an assembled web during continuous manufacturing of the assembled web the method comprising:

passing at least a portion of the assembled web within a field of view of at least one radiometric output measuring device wherein the radiometric measuring device can scan the assembled web using either line imaging or area imaging;

exciting at least one selected micro-component disposed on the assembled web within the field of view to luminescence;

detecting radiation emitted from the selected micro-component;

analyzing the detected radiation; and processing of the assembled web in accordance with the analysis.

12. A method for on-line testing of a plurality of micro-components within an assembled web during a continuous manufacturing process of the assembled web, the method comprising:

passing at least a portion of the assembled web within a field of view of a plurality of radiometric output measuring devices disposed at various locations throughout the continuous manufacturing process;

exciting at least one selected micro-component disposed on the assembled web within the field of view to luminescence;

detecting radiation emitted from the selected micro-component;

analyzing the detected radiation; and disposing of the assembled web in accordance with the analysis.

13. The method of claim 12, wherein a plurality of micro-components are excited.

14. The method of claim 12, wherein the entire assembled web is passed within the field of view and all of the micro-components within the field of view are excited.

15. The method of claim 14, further comprising accumulating a length of the assembled web within the field of view.

16. The method of claim 12, wherein the plurality of radiometric output measuring devices are each connected to a central processor and the step of analyzing the detected radiation is conducted by he central processor.

17. A method of on-line testing a light-emitting panel during continuous manufacturing o the panel, the method comprising:

passing at least a portion of the light-emitting panel within a field of view of at least one radiometric measuring device;

exciting at least one selected micro-component disposed on the light-emitting panel within the field of view to luminescence;

detecting radiation emitted from the selected micro-component;

analyzing the detected radiation; and, disposing of the light-emitting panel in accordance with the analysis.

18. The method of claim 17, wherein the step of analyzing the detected radiation comprises:

determining the existence or absence of radiation;

determining the color of the radiation;

determining the intensity of the radiation; and, logging occurrences of absence of radiation, improper color or inadequate intensity; and the step of disposing of the light-emitting panel comprises;

using display programming to compensate for the absence of radiation, improper color, or inadequate intensity.

19. The method of claim 17 wherein:

the light emitting panel comprises an arrangement of electrodes and control circuitry to address individual micro-components within the panel; and, the step of exciting further comprises using the electrodes and control circuitry to excite at least one micro-component.

* * * * *

UNITED STATES PATENT AND TRADEMARK OFFICE

CERTIFICATE OF CORRECTION

PATENT NO. : 6,935,913 B2
DATED : August 30, 2005
INVENTOR(S) : Wyeth et al.

It is certified that error appears in the above-identified patent and that said Letters Patent is hereby corrected as shown below:

Title page,
Item [56], References Cited, OTHER PUBLICATIONS, add:
-- International Search Report for Application No. PCT/US01/42803, dated December 9, 2002 (mailing date) --.
"Sheats, James," reference, change "Diodes (OLEDs)" [online], [received on May 9, 2002], 8" to -- Diodes (OLEDs)" [online], [retrieved on May 9, 2002], 8 --; and change "com/intro_pled.htm." to -- com/intro_oled.htm. --;
"Sauvante, Michael" reference, change "[retreived on May 9, 2002], 4 pp., Retrieved from the" to -- [retrieved on May 9, 2002], 4 pp., Retrieved from the --;
""Rolltronics"" reference, change ""Rolltronics" [online], Feb. 20, 2000 [retreived on Mar. 12," to -- "Rolltronics" [online], Feb. 20. 2000 [retrieved on Mar. 12, --;
"LG Electronics Held in Ceremony…" reference, change "LG Electronics Held the Ceremony for the Complexion of" to -- "LG Electronics Held the Ceremony for the Completion of --;
"Alien Technology Corporation's Technology Overview;" reference, change "technology.com/d/technology/overview.html, no month." to
-- technology.com/d/technology/overview.html. --; change
""Transparent Conductive Coatings," Copyright 1998, 4 pp., no month." to
-- "Transparent Conductive Coatings," Copyright 1998, 4 pp. --; and
"Stearns, Thomas H.," reference, change "1996, no month." to -- 1996. --.

Column 22,
Line 38, change "selected ea of the assembled web;" to -- selected area of the assembled web; --.

Column 23,
Line 4, please change "cence from the assembled web rid adding a replace-" to
-- cence from the assembled web and adding a replace- --.

Column 24,
Line 34, change "radiation is conducted by he central processor." to -- radiation is conducted by the central processor. --.
Line 36, change "during continuous manufacturing o the panel, the method" to
-- during continuous manufacturing of the panel, the method --.

UNITED STATES PATENT AND TRADEMARK OFFICE

CERTIFICATE OF CORRECTION

PATENT NO. : 6,935,913 B2
DATED : August 30, 2005
INVENTOR(S) : Wyeth et al.

It is certified that error appears in the above-identified patent and that said Letters Patent is hereby corrected as shown below:

Column 24 (cont'd),
Line 55, change "the step of disposing of the light-emitting panel comprises;" to -- the step of disposing of the light-emitting panel comprises: --.

Signed and Sealed this

Fourteenth Day of February, 2006

JON W. DUDAS
*Director of the United States Patent and Trademark Office*